US010829693B2

(12) United States Patent
Otterstrom

(10) Patent No.: US 10,829,693 B2
(45) Date of Patent: Nov. 10, 2020

(54) APPARATUS, SYSTEM, AND METHOD FOR SHALE PYROLYSIS

(71) Applicant: PYRO DYNAMICS L.L.C., Pleasant Grove, UT (US)

(72) Inventor: Gary G. Otterstrom, Lindon, UT (US)

(73) Assignee: Pyro Dynamics LLC, Pleasant Grove, UT (US)

( * ) Notice: Subject to any disclaimer, the term of this patent is extended or adjusted under 35 U.S.C. 154(b) by 40 days.

(21) Appl. No.: 16/116,762

(22) Filed: Aug. 29, 2018

(65) Prior Publication Data

US 2019/0062637 A1 Feb. 28, 2019

Related U.S. Application Data

(60) Provisional application No. 62/552,100, filed on Aug. 30, 2017, provisional application No. 62/585,423, filed on Nov. 13, 2017, provisional application No. 62/585,434, filed on Nov. 13, 2017, provisional application No. 62/594,844, filed on Dec. 5, 2017, (Continued)

(51) Int. Cl.

| | |
|---|---|
| ***C10B 53/06*** | (2006.01) |
| ***C10B 57/00*** | (2006.01) |
| ***C10B 1/04*** | (2006.01) |
| ***C10B 49/22*** | (2006.01) |
| ***C10B 49/06*** | (2006.01) |

(52) U.S. Cl.

CPC ..... *C10B 53/06* (2013.01); *C10B 1/04* (2013.01); *C10B 49/06* (2013.01); *C10B 49/22* (2013.01); *C10B 57/005* (2013.01)

(58) Field of Classification Search

CPC ..... C10B 1/04; C10B 49/06; C10B 49/22; C10B 53/06; C10B 57/005; C10B 57/02; C10G 1/02

See application file for complete search history.

(56) References Cited

U.S. PATENT DOCUMENTS 2,752,292 A 6/1956 Scott
3,377,266 A 4/1968 Salnikov
(Continued)

FOREIGN PATENT DOCUMENTS

GB 487983 A 6/1938

OTHER PUBLICATIONS

PCT Application No. PCT/US2018/048614 filed Aug. 29, 2018, Written Opinion of the International Searching Authority dated Feb. 7, 2019.

*Primary Examiner* — Prem C Singh
*Assistant Examiner* — Brandi M Doyle
(74) *Attorney, Agent, or Firm* — Kunzler Bean & Adamson; Bruce R. Needham

(57) ABSTRACT

Apparatuses, systems, and methods are disclosed for shale pyrolysis. A retort for shale pyrolysis may include a pyrolysis zone, a combustion zone, and a cool down zone. The pyrolysis zone may include one or more pyrolysis zone heat exchangers that transfer heat from a working fluid to shale for heating and pyrolyzing the shale. The combustion zone may include one or more injectors that inject oxygen to combust coke residue in the pyrolyzed shale. The cool down zone may include one or more cool down zone heat exchangers that cool the shale by transferring heat to the working fluid. In a further embodiment, the working fluid is circulated to heat the pyrolysis zone heat exchangers.

17 Claims, 12 Drawing Sheets

Related U.S. Application Data provisional application No. 62/618,519, filed on Jan. 17, 2018.

(56) References Cited

U.S. PATENT DOCUMENTS

| | | | | | |
|---|---|---|---|---|---|
| 3,384,569 | A | | 5/1968 | Peet | |
| 3,972,801 | A | * | 8/1976 | Gregoli | C10G 1/02 208/411 |
| 4,010,092 | A | | 3/1977 | Deering | |
| 4,464,247 | A | * | 8/1984 | Thacker | C10G 1/02 201/31 |
| 4,600,476 | A | * | 7/1986 | Edwards | C10B 1/04 202/120 |
| 4,619,738 | A | * | 10/1986 | Lewis | C10G 1/02 201/28 |
| 4,880,528 | A | * | 11/1989 | Westhoff | C10G 1/02 208/409 |
| 4,900,429 | A | | 2/1990 | Richardson | |
| 8,328,992 | B1 | * | 12/2012 | Swain | C10B 1/04 202/108 |
| 2005/0194244 | A1 | | 9/2005 | Merrell et al. | |
| 2008/0314726 | A1 | * | 12/2008 | Choros | C10B 53/00 202/105 |

* cited by examiner

APPARATUS, SYSTEM, AND METHOD FOR SHALE PYROLYSIS

CROSS-REFERENCES TO RELATED APPLICATIONS

This application claims the benefit of U.S. Provisional Patent Application No. 62/552,100 entitled "APPARATUS, SYSTEM, AND METHOD FOR SHALE PYROLYSIS" and filed on Aug. 30, 2017, for Gary G. Otterstrom; U.S. Provisional Patent Application No. 62/585,423 entitled "APPARATUS, SYSTEM, AND METHOD FOR SHALE PYROLYSIS" and filed on Nov. 13, 2017, for Gary G. Otterstrom; U.S. Provisional Patent Application No. 62/585,434 entitled "APPARATUS, SYSTEM, AND METHOD FOR SHALE PYROLYSIS" and filed on Nov. 13, 2017, for Gary G. Otterstrom; U.S. Provisional Patent Application No. 62/594,844 entitled "APPARATUS, SYSTEM, AND METHOD FOR SHALE PYROLYSIS" and filed on Dec. 5, 2017, for Gary G. Otterstrom; and U.S. Provisional Patent Application No. 62/618,519 entitled "APPARATUS, SYSTEM, AND METHOD FOR SHALE PYROLYSIS" and filed on Jan. 17, 2018, for Gary G. Otterstrom; each of which is incorporated herein by reference.

FIELD

The subject matter disclosed herein relates to oil and gas production and more particularly relates to shale pyrolysis.

BACKGROUND

Oil and gas may be produced from oil shale by a process of pyrolysis. At suitably high temperatures, kerogen in the shale thermally decomposes, releasing gases and vapors that may be recovered as shale gas and shale oil. Although oil shale is abundant, shale oil production costs have, at times, been uncompetitive with economical sources of conventional crude oil. Shale oil production costs may include the cost of retorting equipment with limited throughput, pre-production costs (e.g., to meet shale particle size limits), energy costs, water costs, and the like.

SUMMARY

Apparatuses, systems, and methods are disclosed for shale pyrolysis. A system, in one embodiment, includes a retort for shale pyrolysis. In a certain embodiment, a retort includes a pyrolysis zone, a combustion zone, and a cool down zone. The pyrolysis zone, in one embodiment, includes one or more pyrolysis zone heat exchangers that transfer heat from a working fluid to shale for heating and pyrolyzing the shale. In a certain embodiment, the combustion zone includes one or more injectors that inject oxygen to combust coke residue in the pyrolyzed shale. In one embodiment, the cool down zone includes one or more cool down zone heat exchangers that cool the shale by transferring heat to the working fluid. In a further embodiment, the working fluid is circulated to heat the pyrolysis zone heat exchangers.

In one embodiment, the pyrolysis zone is disposed above the combustion zone and the combustion zone is disposed above the cool down zone. In a further embodiment, a shale loading interlock may be disposed above the pyrolysis zone, and a shale removal interlock may be disposed below the cool down zone to produce a vertical flow of shale through the pyrolysis zone, the combustion zone, and the cool down zone. In certain embodiments, a dwell time for shale in the combustion zone may be shorter than a dwell time for shale in the pyrolysis zone and a dwell time for shale in the cool down zone.

In one embodiment, the pyrolysis zone heat exchangers may include one or more angled surfaces to produce motion of shale descending through the pyrolysis zone. In a certain embodiment, the injectors may inject steam with the oxygen to produce additional heat in a water-gas shift reaction.

In one embodiment, a first distillation chamber may receive gases exiting the pyrolysis zone, and a second distillation chamber may receive gases exiting the cool down zone. In a certain embodiment, a distillation chamber may include one or more filters that filter fines from gases entering the distillation chamber. In a further embodiment, a distillation chamber may include one or more heat exchangers that remove one or more distillate products from the gases. In some embodiments, a distillation chamber may include one or more electrical generators powered by heat remaining in the gases.

In one embodiment, one or more steam cannons may heat water to produce steam, and a pump may circulate water as the working fluid through the one or more heat exchangers of the distillation chambers, through the steam cannons to convert the water to steam, and through the pyrolysis zone, the combustion zone, and/or the cool down zone. In a certain embodiment, a wet sulfuric acid plant may use hydrogen sulfide from gases produced in the retort to produce sulfuric acid and heat, use the heat to convert water to steam, and return the steam to the pyrolysis zone heat exchangers.

In one embodiment, the one or more pyrolysis zone heat exchangers include an array of descending angled surfaces at alternating angles configured to form zig-zag descending passages for the shale. In a further embodiment, the one or more pyrolysis zone heat exchangers may be configured to prevent bridging of shale particles across the zig-zag descending passages. In a certain embodiment, the one or more pyrolysis zone heat exchangers include one or more channels for circulating the working fluid, such that heat is transferred between the working fluid and the descending angled surfaces. In some embodiments, the one or more pyrolysis zone heat exchangers include one or more apertures for injecting the working fluid directly into the shale. In a certain embodiment, the one or more pyrolysis zone heat exchangers include one or more gas collection apertures for removing gases from the pyrolysis zone. In some embodiments, the one or more gas collection apertures may be shielded on top to exclude descending fines from the one or more gas collection apertures. In certain embodiments, the retort may be configured to pyrolyze shale with nonuniform particle sizes from 0-4 inches in diameter. In certain embodiments, compressed air may be injected into an upper portion of the cool-down zone, to combust remaining coke residue.

A method of shale pyrolysis, in one embodiment, includes pyrolyzing shale by heating the shale in a retort. In a certain embodiment, the method includes injecting oxygen into the retort to combust coke residue in the pyrolyzed shale. In a further embodiment, the method includes using heat from the combustion to pyrolyze additional shale in the retort, and/or in an additional retort.

In one embodiment, a method further includes injecting steam with the oxygen to produce additional heat in a water-gas shift reaction. In certain embodiments, a method further includes receiving gases from the retort in one or more distillation chambers. In a further embodiment, a method includes filtering fines from gases entering the one or more distillation chambers. In various embodiments, a method includes using one or more heat exchangers in distillation chambers to remove one or more distillate products from the gases. In certain embodiments, a method includes powering one or more electrical generators using heat remaining in the gases.

A system, in another embodiment, includes one or more distillation chambers that receive gases containing condensable hydrocarbons. In certain embodiments, a distillation chamber includes one or more filters that filter fines from gases entering the distillation chamber. In a further embodiment, a distillation chamber includes one or more heat exchangers that remove one or more distillate products from the gases. In one embodiment, a distillation chamber includes one or more electrical generators powered by heat remaining in the gases.

In one embodiment, one or more steam cannons may heat water to produce steam, and a pump may circulate water through the one or more heat exchangers of the distillation chambers to preheat the water, through the steam cannons to convert the water to steam, and to a vessel where the steam is used in production of the gases. In a certain embodiment, a wet sulfuric acid plant may use hydrogen sulfide from the gases to produce sulfuric acid and heat, use the heat to convert water to steam, and return the steam to a vessel where the steam is used in production of the gases.

In a further embodiment, a retort for shale pyrolysis may produce the gases. In one embodiment, a retort may include a pyrolysis zone, a combustion zone, and a cool down zone. The pyrolysis zone, in one embodiment, includes one or more pyrolysis zone heat exchangers that transfer heat from a working fluid to shale for heating and pyrolyzing the shale. In a certain embodiment, the combustion zone includes one or more injectors that inject oxygen to combust coke residue in the pyrolyzed shale. In a further embodiment, the cool down zone includes one or more cool down zone heat exchangers that cool the shale by transferring heat to the working fluid. In certain embodiment, the working fluid is circulated to heat the pyrolysis zone heat exchangers.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
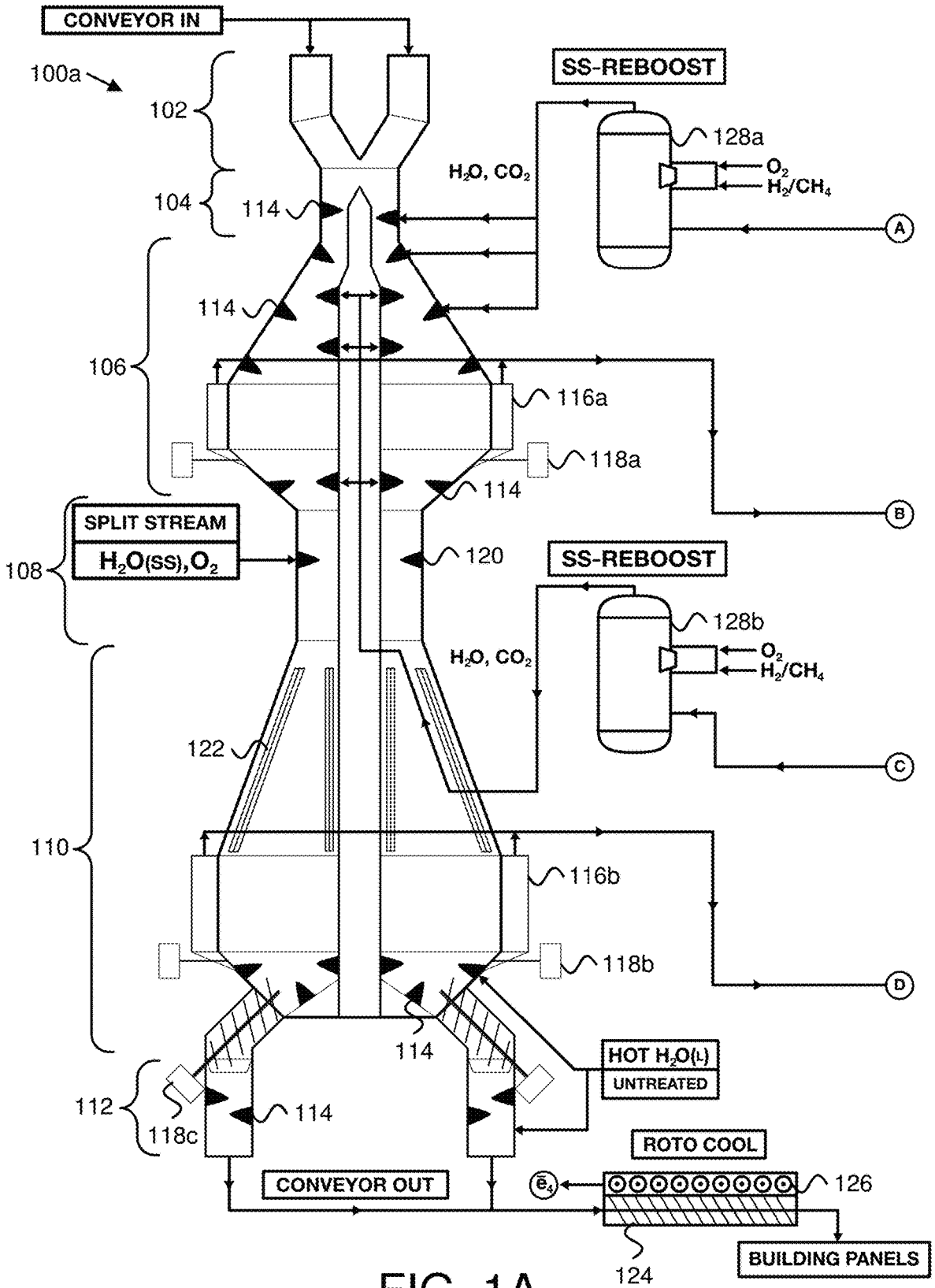
FIG. 1A is a cross section view illustrating one embodiment of a portion of a shale pyrolysis system, comprising a retort.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

FIGS. 1A-10 depict a system for shale pyrolysis, in one embodiment. In certain embodiments, a shale pyrolysis system may include a retort 100 where pyrolysis occurs, releasing gases from thermally decomposing kerogen, distillation chambers 500 where gases condense to form one or more distillate cuts or fractions, liquid/gas separation equipment 600 that removes water and light oil from the pyrolysis products that remain in the gas phase after distillation, a gas plant 700 that treats the gas from the liquid/gas separation equipment 600, and a water treatment plant 1000 that treats the water from the liquid/gas separation equipment 600. In further embodiments, a shale pyrolysis system may include further components such as a tank farm 800 that stores reactants and products, an electrical distribution plant 900, or the like. The shale pyrolysis system of FIGS. 1A-10 is depicted for illustrative and not limiting purposes. A shale pyrolysis system, in another embodiment, may include a variety of components not depicted in FIGS. 1A-10, may omit certain components depicted in FIGS. 1A-10, and/or may include variations or other embodiments of the depicted components.

FIG. 1A depicts one embodiment of a portion of a shale pyrolysis system, comprising a retort 100*a*. The retort 100*a* is depicted in cross-section, so that interior components are visible. In the depicted embodiment, the shale pyrolysis system further comprises one or more steam cannons 128, as described below. A retort 100*a* for shale pyrolysis, in various embodiments, may be any vessel configured to heat shale for pyrolysis. In the depicted embodiment, the retort 100*a* includes a pyrolysis zone 106, a combustion zone 108, and a cool down zone 110, as described below.

In various embodiments, a zone may be a portion of a retort 100*a*, a region or volume of a retort 100*a*, a section of a retort 100*a*, or the like. The term "zone" may be used herein to refer to components of a region or portion of a retort 100*a*, and/or to refer to the volume surrounded by such components. For example, a portion of the wall of a retort 100*a*, or a volume of shale within a retort 100*a* may both be said to be within a "zone."

In certain embodiments, a retort 100*a* may be vertically oriented so that different zones are at different heights. In the depicted embodiment, the pyrolysis zone 106 is disposed above the combustion zone 108, and the combustion zone 108 is disposed above the cool down zone 110. In the depicted embodiment, shale is fed in through the top of the retort 100*a*, and removed through the bottom of the retort 100*a*, so that when the retort 100*a* is filled, the feed rate at the bottom determines the rate at which shale descends through the retort 100*a*. In another embodiment, however, a horizontal retort 100*a* may similarly include zones for pyrolysis, combustion, and cooling down shale.

The pyrolysis zone 106, in various embodiments, may be any region of the retort 100*a* configured to heat and pyrolyze shale. As described above, oil shale may contain kerogen, which breaks down when heated, forming shale oil (which may be gaseous at high-temperature, but condensable), oil shale gas (which may remain gaseous at lower temperature), and a solid coke residue. The term "pyrolysis" is used herein with reference to both kerogen and shale, to refer to the thermal decomposition of kerogen in the shale. Thus, kerogen pyrolysis may refer directly to the process of thermally decomposing kerogen, and shale pyrolysis may similarly refer to the process of pyrolyzing kerogen in the shale, even though the shale may additionally include inorganic matter and/or organic non-kerogen matter that does not decompose during pyrolysis of the kerogen.

The pyrolysis zone 106, in various embodiments, includes one or more pyrolysis zone heat exchangers. A pyrolysis zone heat exchanger, in various embodiments, may be any element or structure configured to transfer heat to shale for pyrolyzing the shale. In the depicted embodiment, the pyrolysis zone heat exchangers include heated paddles 114 that extend from the walls of the retort 100*a* for heating and pyrolyzing shale. In various embodiments, a paddle 114 may be a protrusion, which may be oar-shaped, fin-shaped, wedge-shaped, or otherwise broad in such a way that the paddle 114 provides surface area for contacting shale in the retort 100*a*. In various embodiments, the pyrolysis zone heat exchangers or paddles 114 may be heated by circulation of a heated working fluid. A working fluid, in certain embodiments, may be any fluid that is heated in one or more locations, and circulated in liquid and/or gas phases to transfer heat to one or more further locations. For example, in one embodiment, a shale pyrolysis system may use water as a working fluid, and may circulate the working fluid as liquid water in lower-temperature portions of the system, and as steam in higher-temperature portions of the system. Various other working fluids that may be used in addition to or in place of water will be clear in view of this disclosure.

In the depicted embodiment, the pyrolysis zone heat exchangers or paddles 114 are steam-heated. In another embodiment, pyrolysis zone heat exchangers or paddles 114 may be heated by circulation of another working fluid. In one embodiment, the working fluid may circulate through the paddles 114, heating the paddles 114, which in turn heat shale in direct contact with the paddles 114. In certain embodiments, the paddles 114 may include perforations, openings, or apertures for injecting the heated working fluid directly into the shale.

In certain embodiments, heated paddles 114 may extend from one or more of the walls of the retort 100*a*. In various embodiments, a wall for the retort 100*a* may refer to any structure that defines a boundary between an interior volume for containing shale and an exterior or non-shale containing volume. For example, in the depicted embodiment, the retort 100*a* includes a central utility corridor and the walls of the retort 100*a* include the walls at the exterior of the retort 100*a* and the utility corridor walls. In one embodiment, heated paddles 114 may extend into the interior volume of the retort 100*a* from the exterior walls. In another embodiment, heated paddles 114 may extend into the interior volume of the retort 100*a* from utility corridor walls. In the depicted embodiment, heated paddles 114 extend into the interior volume of the retort 100*a* from the exterior walls and the utility corridor walls.

In certain embodiments, the paddles 114 may be angled to produce helical motion of shale descending through the pyrolysis zone 106. For example, a broad surface of a paddle 114 may be angled so that shale rolls off the paddle 114, mixing the shale. In the depicted embodiment, shale is fed in through the top of the retort 100*a*, and removed through the bottom of the retort 100*a*, so that shale in the pyrolysis zone 106 moves downward by gravity, and moves in a spiral or helical path as it passes over the angled paddles 114. The paddles 114 may be angled to direct shale that rolls off the paddles 114 around the retort 100*a*, so that helical motion is produced by a circumferential component induced by the paddles 114 and a downward component induced by gravity. Thus, in the depicted embodiment, the paddles 114 heat, mix and roll shale in the retort 100*a*. Additionally, in certain embodiments, a broad surface of a paddle 114 may support shale in the retort 100*a*, reducing pressure on shale below the paddle 114.

In certain embodiments shale pyrolysis may occur at temperatures of approximately 750-800° F., and the retort 100*a* may retain shale in the pyrolysis zone 106 for a dwell time sufficient to reach pyrolysis temperatures. For example, in the depicted embodiment, the retort 100*a* may be filled or substantially filled with shale particles, so that the rate at which shale is removed from the bottom of the retort 100*a* determines the dwell time for shale in the pyrolysis zone 106.

In one embodiment, the retort 100*a* may include a preheat zone 104, and may be configured so that shale passes through the preheat zone 104 for preheating before entering the pyrolysis zone 106. For example, in the depicted embodiment, the preheat zone 104 is disposed above the pyrolysis zone 106, and includes heated paddles 114 similar to those of the pyrolysis zone 106, that preheat the shale to approximately 200-250° F. Additionally, the preheat zone 104 may be configured so that a dwell time for shale in the preheat zone 104 is less than a dwell time for shale in the pyrolysis zone 106. For example, in the depicted embodiment, the preheat zone 104 is narrower than the pyrolysis zone 106, so that shale descending through the retort 100*a* spends more time in the pyrolysis zone 106 than in the preheat zone 104.

After shale pyrolysis in the pyrolysis zone 106, oil and gas products from the pyrolyzed kerogen may be in a gaseous state, and may be referred to generally herein as gases, where the term "gases" refers both to gas products and to oil products in a gaseous or vapor state. The gases produced by pyrolysis (and additional gases in the pyrolysis zone 106 such as steam injected during pyrolysis, combustion exhaust from the combustion zone 108, and the like) may exit the retort 100*a* through apertures in the pyrolysis zone 106. In the depicted embodiment, small particles or fines carried by the exiting gases may be removed by cyclone separators 116*a*, and returned to the retort 100*a* by augurs 118*a*. Various other ways of separating particulates from the exiting gases will be clear in view of this disclosure. The gases exiting the pyrolysis zone 106 (at B) may be received by a distillation chamber 500 as described below with reference to FIG. 5.

In certain embodiments, the pyrolysis zone 106 may be configured so that pyrolyzed shale is heated further, beyond the point of pyrolysis. For example, in the depicted embodiment, paddles 114 at the bottom of the pyrolysis zone 106 may boost shale temperatures to approximately 850-950° F. before the shale enters the combustion zone 108.

The combustion zone 108, in certain embodiments, includes one or more injectors 120 that inject oxygen to combust coke residue in the pyrolyzed shale. In various embodiments, coke residue may include any solid combustible matter that remains in the shale after pyrolysis, as char, coke, semi-coke, or the like.

Injectors 120, in one embodiment, may be substantially similar to the heated paddles 114 of the pyrolysis zone 106, but may be coupled to an oxygen source to inject oxygen instead of (or in addition to) heated steam or another working fluid. In another embodiment, injectors 120 may be substantially similar to blast furnace tuyeres. Various suitable configurations of oxygen injectors 120 will be clear in view of this disclosure. In one embodiment, the injectors 120 may inject oxygen by injecting air, which contains oxygen. In another embodiment, the injectors 120 may inject oxygen, or an oxygen-containing mixture, without injecting ambient air. Injecting air to combust coke residue in the pyrolyzed shale may be less efficient than injecting oxygen, because nitrogen in the air absorbs heat without contributing to the combustion reaction. Additionally, introducing nitrogen into the combustion zone 108 may produce undesirable nitric oxide and nitrogen dioxide (NOx) emissions. By contrast, in certain embodiments, oxy-fuel combustion using oxygen instead of air to combust coke residue in the pyrolyzed shale may result in higher temperatures in the combustion zone 108, and less NOx production.

In certain embodiments, combusting the coke residue using oxygen may boost temperatures in the combustion zone 108 above 1000° F. For example, temperatures in areas closest to combusting shale may be approximately 1800-1850° F. In various embodiments, pressure in the retort 100*a* may be highest in the combustion zone 108, so that gas flows away from the combustion zone 108 towards other zones such as the pyrolysis zone 106 and the cool down zone 110. In certain embodiments, the amount of oxygen injected by the injectors 120 may be regulated or controlled so that the injected oxygen is substantially consumed by combustion of coke reside in the combustion zone 108, rather than substantially contributing to combustion in the pyrolysis zone 106. Limiting the amount of oxygen that enters the pyrolysis zone 106 may allow the kerogen in the shale to pyrolyze instead of combusting.

In certain embodiments, heat from the combustion zone 108 may be transferred to the pyrolysis zone 106 by the combustion exhaust gases, facilitating pyrolysis. For example, combustion of coke residue may produce heated carbon dioxide and steam, which enters the pyrolysis zone 106 due to a pressure differential. Additionally, heat from combustion of coke residue may be transferred to the working fluid by heat exchangers 122, and circulated to the heated paddles 114 of the pyrolysis zone 106, as described below with reference to the cool down zone 110.

The injectors 120, in certain embodiments, may inject steam with the oxygen, to produce additional heat in a water-gas shift reaction. In the water-gas shift reaction, carbon monoxide reacts with steam, producing carbon dioxide, hydrogen, and heat. Thus, injecting steam with the oxygen may result in cleaner combustion with less carbon monoxide, may produce heat that may be used for pyrolysis, and may produce hydrogen as an additional useful product.

The combustion zone 108, in the depicted embodiment, is narrower than the pyrolysis zone 106 and the cool down zone 110. In certain embodiments, the dwell time for shale in various zones may depend on the volume rate at which spent shale is removed at the bottom of the retort 100*a*, and on cross-sectional areas of the different zones. In certain embodiments, pyrolysis may take more time than combustion, and the combustion zone 108 may be narrower than the pyrolysis zone 106, so that a dwell time for shale particles in the combustion zone 108 is shorter than a dwell time for shale particles in the pyrolysis zone 106. Similarly, the cool down zone 110 may be wider than the combustion zone 108, so that a dwell time for shale particles in the combustion zone 108 is shorter than a dwell time for shale particles in the pyrolysis zone 106.

The cool down zone 110, in certain embodiments, includes one or more heat exchangers 122 that cool the combusted shale by transferring heat to a working fluid. In various embodiments, heat exchangers 122 may include one or more tubes, pipes, channels, or the like, through which the working fluid is circulated. The heat exchangers 122 may be heated by shale particles and/or exhaust gases exiting the combustion zone 108. In certain embodiments, the working fluid is circulated from the heat exchangers 122 to heat the paddles 114 of the pyrolysis zone 106. For example, in one embodiment, steam may be circulated through the heat exchangers 122, superheated by heat from the cool down zone 110, and circulated to the paddles 114 of the pyrolysis zone 106, so that heat from combustion and from the water-gas shift reaction is transferred to the pyrolysis zone 106 to pyrolyze shale.

In certain embodiments, the water-gas shift reaction caused by injecting steam into the combustion zone 108 may continue in the cool down zone 110 at lower temperatures, until temperatures fall below a quenching temperature for the water-gas shift reaction. In another embodiment, however, the rate of steam injection may be controlled so that the water-gas shift reaction completes in the combustion zone 108 and does not continue in the cool down zone 110. Similarly, oxygen injection rates and shale dwell time in the combustion zone 108 may be managed or controlled so that combustion completes in the combustion zone 108, or so that combustion continues in the cool down zone 110 until coke residue is consumed, oxygen is consumed, or the temperature in the cool down zone 110 falls below a combustion temperature.

In certain embodiments, gases produced by combustion, gases produced by the water-gas shift reaction, and additional gases in the cool down zone 110 such as steam injected for cooling, combustion exhaust from the combustion zone 108, and the like, may exit the retort 100*a* through apertures in the cool down zone 110. In the depicted embodiment, small particles or fines carried by the exiting gases may be removed by cyclone separators 116*b*, and returned to the retort 100*a* by augurs 118*b*. The gases exiting the cool down zone 110 (at D) may be received by a distillation chamber 500 as described below with reference to FIG. 5.

In a certain embodiment, shale may be further cooled in the cool down zone 110 by paddles 114 similar to the paddles 114 of the pyrolysis zone 106. However, while the paddles 114 of the pyrolysis zone 106 may be configured to heat shale to pyrolysis temperatures of approximately 750-800° F., the paddles 114 of the cool down zone 110 may be configured to cool shale. For example, in one embodiment, the paddles 114 of the pyrolysis zone 106 may circulate and inject steam at or above 750-800° F., and the paddles 114 of the cool down zone 110 may circulate and/or inject steam at or near 212° F., or may be cooled by liquid water below 212° F. or by another, lower temperature working fluid.

In one embodiment, shale descending through the cool down zone 110 may be cooled first by heat exchangers 122 at the top of the cool down zone 110, so that high-temperature shale from the combustion zone 108 boosts the working fluid to temperatures sufficient for facilitation pyrolysis in the pyrolysis zone 106. The shale cooled by the heat exchangers 122 may subsequently be further cooled by paddles 114 at the bottom of the cool down zone 110.

In the depicted embodiment, a shale loading interlock 102 is disposed above the pyrolysis zone 106, and a shale removal interlock 112 is disposed below the cool down zone 110 to produce a vertical flow of shale through the pyrolysis zone 106, the combustion zone 108, and the cool down zone 110. In certain embodiments, an interlock may include two openings or doors, so that shale particles may be moved through the interlock without opening the retort 100*a* directly to ambient air. For example, shale may be loaded into an interlock via an interlock entrance while an interlock exit is closed, and then may be removed from the interlock via the interlock exit while the interlock entrance is close.

The shale loading interlock 102, in the depicted embodiment, is disposed at the top of the retort 100*a*, above the preheat zone 104 and the pyrolysis zone 106. In another embodiment, shale may be heated and pyrolyzed in the pyrolysis zone 106 without being separately preheated in a preheat zone 104, and the shale loading interlock 102 may be disposed directly above the pyrolysis zone 106. The shale loading interlock 102 may receive shale particles from a conveyor, a hopper, or the like, and transfer the shale particles into the retort 100*a*. In certain embodiments, efficient heat transfer into the shale from the paddles 114 of the pyrolysis zone 106 may allow shale particles of various sizes to be effectively pyrolyzed. Thus, in one embodiment, a retort 100*a* may be configured to pyrolyze shale particles from 0-4 inches in diameter. In a further embodiment, a retort 100*a* may be configured to pyrolyze shale particles from 0-6 inches in diameter. In a certain embodiment, a retort 100*a* may be configured to pyrolyze shale particles from 0-8 inches in diameter, or larger. Shale may be preprocessed accordingly to suitable particle sizes for the retort 100*a*, and loaded into the shale loading interlock 102. Additionally, in certain embodiments, coal fines or other carbonaceous material may be loaded into the shale loading interlock 102, and loaded into the retort 100*a* for pyrolysis in the pyrolysis zone 106, and combustion in the combustion zone 108. In certain embodiments, coke residue in larger shale particles may not be fully combusted in the combustion zone 108, and adding coal fines or other carbonaceous material into the retort 100*a* may provide additional combustible material to produce heat in the combustion zone 108.

The shale removal interlock 112, in the depicted embodiment, is disposed below the cool down zone 110, and receives spent shale from the cool down zone 110. In the depicted embodiment, augurs 118*c* move shale from the cool down zone 110 into the shale removal interlock 112. In another embodiment, shale may be moved from the cool down zone 110 into the shale removal interlock 112 in another way. In various embodiments, removing shale via the shale removal interlock 112 may produce a vertical flow of shale through the retort 100*a*, allowing more shale to be added via the shale loading interlock 102.

In one embodiment, the shale removal interlock 112 may include further paddles 114 for cooling shale. For example, in a certain embodiment, water may be circulated through paddles 114 of the shale removal interlock 112 to cool the shale, forming low-temperature steam (e.g., at or near 212° F.), may then be injected into the shale through paddles 114 of the cool down zone 110, and may exit the cool down zone 110 with other gases through apertures and cyclone separators 116*b*.

In certain embodiments, spent shale from the shale removal interlock 112 may be conveyed to a rotational cooler 124 to be further cooled by rotating the shale through air, water, another fluid, or the like. In the depicted embodiment, the rotational cooler 124 includes electrical generators 126 powered by heat remaining in the spent shale. For example, in one embodiment, a rotational cooler 124 may include one or more organic Rankine cycle generators or other heat-powered electrical generators powered by heat from the spent shale. After cooling, spent shale may be used in cement or concrete, cinder block bricks, other building materials, or the like.

In the depicted embodiment, one or more steam cannons 128 heat water to produce steam, or may heat another working fluid to a gaseous state. In the depicted embodiment, the steam cannons 128 heat water by oxy-fuel combustion, using hydrogen and/or methane as fuel. In another embodiment, steam cannons 128 may heat water by oxy-fuel combustion with another fuel. As described above in relation to the combustion zone 108, oxy-fuel combustion may provide efficient heating, without heating the nitrogen component of ambient air. In another embodiment, however, a steam cannon 128 may heat water by combustion of fuel with air, by electrical heating, or in another way.

In the depicted embodiment, a pump (such as the pump 1002 of FIG. 10) may circulate water as the working fluid through one or more heat exchangers 504 in distillation chambers 500 (as described below with reference to FIG. 5), where the water is heated, as gases from the pyrolysis zone 106 and/or the combustion zone 108 are cooled. The water may then be circulated through the steam cannons 128 to convert the water to steam, and may then be circulated as steam through the pyrolysis zone 106, the combustion zone 108, and/or the cool down zone 110. For example, in the depicted embodiment, a first steam cannon 128*a* receives heated water (at A) from a first distillation chamber 500*a*, and boosts the water to steam. The steam from the first steam cannon 128*a* (along with carbon dioxide from combustion in the steam cannon 128*a*) is received, circulated, and injected by paddles 114 of the pyrolysis zone 106 to pyrolyze shale.

A second steam cannon 128*b*, in the depicted embodiment, receives heated water (at C) from a second distillation chamber 500*b*, and boosts the water to steam. The steam from the second steam cannon 128*b* is circulated through the heat exchangers 122 of the cool down zone 110, where it receives heat from combustion and the water-gas shift reaction. The steam is then received, circulated, and injected by paddles 114 of the pyrolysis zone 106 to pyrolyze shale. Steam injected in the combustion zone 108 for the water-gas shift reaction may also be from the first and/or second steam cannons 128.

In another embodiment, a shale pyrolysis system may include more or fewer steam cannons 128. For example, in certain embodiments, a shale pyrolysis system may include more than two steam cannons 128, to position steam output closer to individual paddles 114, injectors 120, and/or heat exchangers 122, or may include a single steam cannon 128 that provides steam to paddles 114, injectors 120, and heat exchangers 122. In another embodiment, a shale pyrolysis system without steam cannons 128 may generate steam at the heat exchangers 122. In certain embodiments, using a pump to circulate liquid water through distillation chamber heat exchangers 504 before using steam cannons 128 to boost the water to steam may provide efficient heat transfer using a liquid working fluid, without using a compressor to compress and move a gaseous working fluid.

In certain embodiments, steam cannons 128 may heat liquid water to produce steam, and/or may receive steam and heat the steam further. For example, in one embodiment, distillation chamber heat exchangers 504 may heat water to steam, and the steam cannons 128 may further heat the steam, and/or may add additional steam by heating liquid water received from a pump, before sending the steam to the pyrolysis zone 106, the combustion zone 108, and/or the cool down zone 110.

In certain embodiments, the retort 100*a* may have a square or rectangular cross section, or a substantially square or rectangular cross section, with flat sides. Narrowing of the combustion zone 108 may be provided by protrusions or trunnions that extend inward from the retort 100*a* walls, so that an outer wall of the retort 100*a* is flat, but the retort 100*a* narrows internally at the combustion zone 108. Walls of the pyrolysis zone 106 and the cool down zone 110 may be fixed or anchored at the trunnions of the combustion zone 108, and may expand when the retort 100*a* is in use, due to heating. Accordingly, expansion joints may be provided for walls of the retort 100*a* at non-fixed ends of the pyrolysis zone 106 and of the cool down zone 110

The heated fins, paddles, or heat exchangers described above for the pyrolysis zone 106 and the cool down zone 110 may take the form of augur-shaped structures that extend vertically through the pyrolysis zone 106 and the cool down zone 110. A metal ramp spiraling around the augur shaped structures may be steam-heated to heat shale, and may include jets to inject steam for further heating. Shale may be heated and rolled as it descends past the augur-shaped structures. The ramp-shaped portions of the augur-shaped structures may be vertically staggered to facilitate shale movement. Cyclone separators as described above may be disposed at lower and/or upper ends of the augur-shaped structures, and gases that exit the pyrolysis zone 106 and/or the cool down zone 110 may exit the cyclone separators through tubes or pipes that extend through the center of the augur-shaped structures.

In one embodiment, an augur-shaped structure extending vertically through the pyrolysis zone 106 or the cool down zone 110 may have a square core, and a metal ramp-shaped radiator extending around the core in a square spiral. The augur-shaped structure may be made of high-Inconel stainless steel. A cyclone separator at the at the end of an augur-shaped structure may include perforations that receive gases and fine particles, and may collect fine particles while allowing gases to exit through tubes or pipes that extend through the core of the augur-shaped structure. A cyclone separator may include a pressure-driven plug that is operable by back-pressurizing the plug, to empty fine particles out of the cyclone.

In one embodiment, combustion in the combustion zone 108 may be incomplete, and additional carbon may remain in the combusted shale. In a further embodiment, combusting the remaining carbon may provide additional heat for shale pyrolysis, and additional carbon dioxide and water that may be used by an algae plant 1010. The additional heat, after being used for shale pyrolysis, may also increase electrical power output from the generators 126, 502, which may be used by the plant (e.g., for algae pond stirring), or output for commercial use. To combust additional carbon, in one embodiment, a further zone may be provided below the cool down zone 110, with additional augur-shaped structures and/or paddles that inject air or oxygen to combust carbon remaining in the shale, and that inject steam to control the temperature. In another embodiment, augur-shaped structures in the cool down zone 110 may inject air or oxygen to combust carbon remaining in the shale, and may inject steam to control the temperature, so that combustion of remaining carbon occurs in the cool down zone 110 rather than in a further zone.

In certain embodiments, multiple retorts 100 may be ganged and used together with the distillation chambers 500 and other components described above, A system including multiple retorts 100 may provide fast shale processing, and may allow maintenance downtime for individual retorts 100 to be staggered.

Figure 1B:
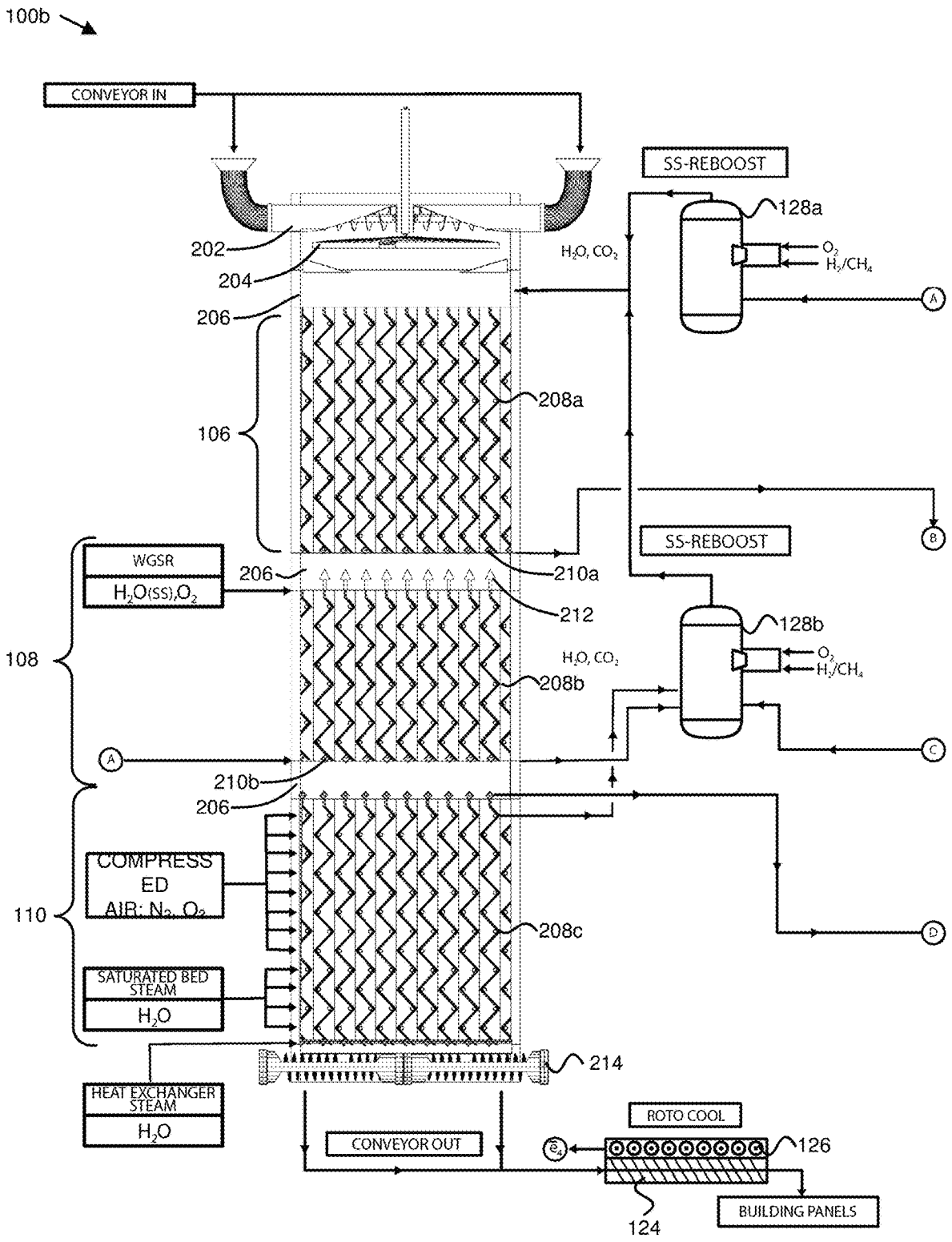
FIG. 1B is a cross section view illustrating another embodiment of a portion of a shale pyrolysis system, comprising another embodiment of a retort.

FIG. 1B is a cross section view illustrating another embodiment of a portion of a shale pyrolysis system, comprising another embodiment of a retort 100*b*. As in FIG. 1A, the retort 100*b* is depicted in cross-section, so that interior components are visible. In the depicted embodiment, the shale pyrolysis system further comprises one or more steam cannons 128, and a rotational cooler 124 including electrical generators 126, as described above. The retort 100*b*, in the depicted embodiment, includes a pyrolysis zone 106, a combustion zone 108, and a cool down zone 110, which may be substantially similar to the pyrolysis zone 106, combustion zone 108, and cool down zone 110 described above with regard to the retort 100*a* of FIG. 1A.

In the depicted embodiment, the retort 100*b* has a square or rectangular cross section. In certain embodiments, walls of the retort 100*b* may include flat plates that overlap at pressure-sealed expansion joints. At the overlapping joints, the plates may move laterally in relation to other plates, as they expand or contract due to temperature. Certain types of retorts 100 with cylindrical cross sections or curved components may have components that are difficult to ship, or that are larger than the capacity of most trucks. By contrast, in certain embodiments, components for a retort 100*b* with a square or rectangular cross section may be manufactured off-site and shipped on trucks to a location where the retort 100 will be assembled.

In the depicted embodiment, the retort 100*b* is vertically oriented so that different zones are at different heights. In the depicted embodiment, the pyrolysis zone 106 is disposed above the combustion zone 108, and the combustion zone 108 is disposed above the cool down zone 110. In the depicted embodiment, shale is fed in through the top of the retort 100*b*, and removed through the bottom of the retort 100*b*, so that when the retort 100*b* is filled, the feed rate at the bottom determines the rate at which shale descends through the retort 100*b*.

In the depicted embodiment, a shale loading interlock 202 is disposed above the pyrolysis zone 106, and a shale removal interlock 214 is disposed below the cool down zone 110 to produce a vertical flow of shale through the pyrolysis zone 106, the combustion zone 108, and the cool down zone 110. In the depicted embodiment, a shale loading interlock 202 may be substantially similar to the shale loading interlock 102 described above, and may receive shale particles from a conveyor, a hopper, or the like, and transfer the shale particles into the retort 100*b*. The shale loading interlock 202, in the depicted embodiment, is disposed at the top of the retort 100*b*, above the pyrolysis zone 106. In the depicted embodiment, the shale loading interlock 202 includes one or more augurs configured to move shale particles into the retort 100*b*. Shale particles exiting the augur(s) may fall onto or through a rotating plate 204. In certain embodiments, the rotating plate 204 may include apertures for shale particles to fall through. Shale may be distributed across the width of the retort 100*b* as it falls through openings in the rotating plate 204, and/or off the edges of the rotating plate 204

In certain embodiments, efficient heat transfer into the shale in the pyrolysis zone 106 may allow shale particles of various sizes to be effectively pyrolyzed. Thus, in one embodiment, a retort 100*b* may be configured to pyrolyze shale particles from 0-4 inches in diameter. In a further embodiment, a retort 100*b* may be configured to pyrolyze shale particles from 0-6 inches in diameter. In a certain embodiment, a retort 100*b* may be configured to pyrolyze shale particles from 0-8 inches in diameter, or larger. Shale may be pre-processed accordingly to suitable particle sizes for the retort 100*b*, and loaded into the shale loading interlock 202. Additionally, in certain embodiments, coal fines or other carbonaceous material may be loaded into the shale loading interlock 202, and loaded into the retort 100*b* for pyrolysis in the pyrolysis zone 106, and combustion in the combustion zone 108. In certain embodiments, coke residue in larger shale particles may not be fully combusted in the combustion zone 108, and adding coal fines or other carbonaceous material into the retort 100*b* may provide additional combustible material to produce heat in the combustion zone 108.

In the depicted embodiment, a shale removal interlock 214 may be substantially similar to the shale removal interlock 112 described above, and is disposed below the cool down zone 110 to receive spent shale from the cool down zone 110. In the depicted embodiment, the shale removal interlock 214 may include one or more augurs that remove shale from the retort 100*b*. In certain embodiments, a shale removal interlock 214 may include more augurs than a shale loading interlock 202. For example, in one embodiment, a shale loading interlock 202 may include a single augur, a pair of augurs, or the like, to bring shale particles to a central point for distribution across the width of the retort 100*b* by a rotating plate 204. In a further embodiment, a shale removal interlock 214 may include an array of augurs extending across the bottom of the retort 100*b* to receive shale particles without the shale being first brought back to a central point. In various embodiments, removing shale via the shale removal interlock 214 may produce a vertical flow of shale through the retort 100*b*, allowing more shale to be added via the shale loading interlock 202.

In certain embodiments, spent shale from the shale removal interlock 214 may be conveyed to a rotational cooler 124 to be further cooled by rotating the shale through air, water, another fluid, or the like, where the heat may be used to power electrical generators 126, substantially as described above with regard to FIG. 1A. After cooling, spent shale may be used in cement or concrete, cinder block bricks, other building materials, or the like.

The pyrolysis zone 106, as described above, may be any region of the retort 100*b* configured to heat and pyrolyze shale. In various embodiments, as described above, shale pyrolysis may for shale oil (gaseous at high temperature, but condensable), oil shale gas (gaseous at low temperature), and solid coke residue.

The pyrolysis zone 106, in the depicted embodiment, includes one or more pyrolysis zone heat exchangers 208*a*. A pyrolysis zone heat exchanger 208*a*, in various embodiments, may be any element or structure configured to transfer heat to shale for pyrolyzing the shale. In certain embodiments, a pyrolysis zone heat exchanger 208*a* may transfer heat from a working fluid to the shale. A working fluid, in certain embodiments, may be any fluid that is heated in one or more locations, and circulated in liquid and/or gas phases to transfer heat to one or more further locations. In certain embodiments, a shale pyrolysis system may use water as a working fluid, and may circulate the working fluid as liquid water in lower-temperature portions of the system, and as steam in higher-temperature portions of the system. Various other working fluids that may be used in addition to or in place of water will be clear in view of this disclosure.

In one embodiment, a pyrolysis zone heat exchanger 208*a* may transfer heat from a working fluid to the shale by directly injecting the heated working fluid into the shale (e.g. into the shale bed). In a certain embodiment, a pyrolysis zone heat exchanger 208*a* may transfer heat from a working fluid to the shale by circulating the working fluid through one or more channels within a pyrolysis zone heat exchanger 208*a*, to heat the outer surface of the pyrolysis zone heat exchanger 208*a*, thus heating shale particles in contact with the outer surface of the pyrolysis zone heat exchanger 208*a*. In the depicted embodiment, the pyrolysis zone heat exchangers 208*a* are steam-heated. Heat exchangers 208, including pyrolysis zone heat exchangers 208*a*, are described in further detail below with reference to FIGS. 2-4

In certain embodiments, the pyrolysis zone heat exchangers 208*a* may include one or more angled surfaces that produce motion of shale descending through the pyrolysis zone 106. In the depicted embodiment, the pyrolysis zone heat exchangers 208*a* include an array of descending angled surfaces at alternating angles configured to form zig-zag descending passages for the shale. In various embodiments, a descending passage may include any channel or space through which shale descends in the retort 100*b*. In further embodiments, a zig-zag passage may include any passage that descends at alternating angles, so that at least some of the shale moves back and forth horizontally as it descends through the retort 100*b*.

Shale particles may enter the descending passages at the top of the array, and may land on an angled surface of a pyrolysis zone heat exchanger 208*a*. The angled surfaces may support the shale, reducing pressure on the shale bed lower in the retort 100*b*. Additionally, as shale descends through the retort 100*b* (e.g., as spent shale is removed from the bottom of the retort 100*b*), the shale may slide or roll down the angled surfaces of the pyrolysis zone heat exchangers 208*a*, and the surface of the shale in contact with the angled surface may be heated by conduction. As the shale descends further through a zig-zag descending passage, it may slide or roll off of one angled surface, onto an angled surface for a pyrolysis zone heat exchanger 208*a* on an opposite side of the passage. Thus, the shale may be supported, rolled, mixed, and heated as it descends through the pyrolysis zone 106.

In the depicted embodiment, the pyrolysis zone heat exchangers 208*a* are supported by a structural grid 206. In the depicted embodiment, the retort 100*b* includes a plurality of structural grids 206. In various embodiments, a structural grid 206 may include a plurality of support members that extend between opposite walls of the retort 100*b*. For example, in one embodiment, support members may be I-beams, H-beams, C-beams, or the like, and may extend in a first horizontal direction across the retort 100*b*, and in a second horizontal direction across the retort 100*b*, forming a grid of openings between intersecting support members. In certain embodiments, one or more structural grids 206 may provide rigidity for a retort 100. In some embodiments, support members of a structural grid 206 may be enclosed in a metal jacket and/or insulating material, and may be cooled by air or another gas or fluid circulated through the jacket. In certain embodiments, support members may be covered by an angled or peaked structure so that shale slides off of the support members rather than accumulating on a horizontal surface of a support member. A structural grid 206 may be configured so that openings between support members are at least as large as the shale particles received by the retort 100*b*, allowing shale to descend through openings in the structural grid 206. In various embodiments, heat exchangers 208 may be attached to and supported by a structural grid 206, and/or may be attached to and supported by the walls of the retort 100*b*.

In certain embodiments shale pyrolysis may occur at temperatures of approximately 675-800° F., and the retort 100*b* may retain shale in the pyrolysis zone 106 for a dwell time sufficient to reach pyrolysis temperatures. For example, in the depicted embodiment, the retort 100*b* may be filled or substantially filled with shale particles, so that the rate at which shale is removed from the bottom of the retort 100*b* determines the dwell time for shale in the pyrolysis zone 106.

After shale pyrolysis in the pyrolysis zone 106, oil and gas products from the pyrolyzed kerogen may be in a gaseous state, and may be referred to generally herein as gases, where the term "gases" refers both to gas products and to oil products in a gaseous or vapor state. The gases produced by pyrolysis (and additional gases in the pyrolysis zone 106 such as steam injected during pyrolysis, combustion exhaust from the combustion zone 108, and the like) may exit the retort 100*b* through gas collection apertures 210*a* in the pyrolysis zone 106. In certain embodiments, the pyrolysis zone heat exchangers 208*a* may include the gas collection apertures 210*a*. The gases exiting the pyrolysis zone 106 (at B) may be received by a distillation chamber 500 as described below with reference to FIG. 5.

The combustion zone 108, in certain embodiments, includes one or more injectors 212 that inject oxygen to combust coke residue in the pyrolyzed shale. In certain embodiments, the injectors 212 may be substantially similar to the injectors 120 described above with reference to FIG. 1A. In various embodiments, coke residue may include any solid combustible matter that remains in the shale after pyrolysis, as char, coke, semi-coke, or the like.

In certain embodiments, the injectors 212 may be coupled to an oxygen source to inject oxygen. In certain embodiments, injectors 212 may also inject heated steam or another working fluid into the shale bed. In one embodiment, injectors 212 may be substantially similar to blast furnace tuyeres. Various suitable configurations of oxygen injectors 212 will be clear in view of this disclosure. In one embodiment, the injectors 212 may inject oxygen by injecting air, which contains oxygen. In another embodiment, the injectors 212 may inject oxygen, or an oxygen-containing mixture, without injecting ambient air. Injecting air to combust coke residue in the pyrolyzed shale may be less efficient than injecting oxygen, because nitrogen in the air absorbs heat without contributing to the combustion reaction. Additionally, introducing nitrogen into the combustion zone 108 may produce undesirable nitric oxide and nitrogen dioxide (NOx) emissions. By contrast, in certain embodiments, oxy-fuel combustion using oxygen instead of air to combust coke residue in the pyrolyzed shale may result in higher temperatures in the combustion zone 108, and less NOx production.

In certain embodiments, combusting the coke residue using oxygen may boost temperatures in the combustion zone 108 above 1000° F. For example, temperatures in areas closest to combusting shale may be approximately 1800-1850° F. In various embodiments, pressure in the retort 100*b* may be highest in the combustion zone 108, so that gas flows away from the combustion zone 108 towards other zones such as the pyrolysis zone 106 and the cool down zone 110. In certain embodiments, the amount of oxygen injected by the injectors 212 may be regulated or controlled so that the injected oxygen is substantially consumed by combustion of coke reside in the combustion zone 108, rather than substantially contributing to combustion in the pyrolysis zone 106. Limiting the amount of oxygen that enters the pyrolysis zone 106 may allow the kerogen in the shale to pyrolyze instead of combusting.

In certain embodiments, heat from the combustion zone 108 may be transferred to the pyrolysis zone 106 by the combustion exhaust gases, facilitating pyrolysis. For example, combustion of coke residue may produce heated carbon dioxide and steam, which enters the pyrolysis zone 106 due to a pressure differential. Additionally, heat from combustion of coke residue may be transferred to the working fluid by heat exchangers 208*b*, which may be substantially similar to the pyrolysis zone heat exchangers 208*a*, and which may similarly be supported by a structural grid 206 and/or by the walls of the retort 100*b*. In the depicted embodiment, heat exchangers 208*b* of the combustion zone 108 form zig-zag descending passages similar to the descending passages of the pyrolysis zone 106, where shale is supported, rolled, and mixed. However, in the depicted embodiment, the combustion zone heat exchangers 208*b* may transfer heat from combustion to the working fluid, rather than transferring heat from the working fluid to the shale. The heated working fluid may then be circulated to the pyrolysis zone heat exchangers 208*a*.

The injectors 212, in certain embodiments, may inject steam with the oxygen, to produce additional heat in a water-gas shift reaction. In the water-gas shift reaction, carbon monoxide reacts with steam, producing carbon dioxide, hydrogen, and heat. Thus, injecting steam with the oxygen may result in cleaner combustion with less carbon monoxide, may produce heat that may be used for pyrolysis, and may produce hydrogen as an additional useful product.

In certain embodiments, the retort 100*b* may be configured such that a dwell time for shale in the combustion zone 108 is shorter than a dwell time for shale in the pyrolysis zone 106. A dwell time for shale in a zone, in various embodiments, may be an actual time, an average time, a target time, or the like, that a shale particle spends in the zone while descending through the retort 100*b*. The dwell time, in various embodiments, may be affected by the configuration of the retort 100*b*, and by the rate of shale flow through the retort 100*b*. For example, in FIG. 1A, the dwell time in the combustion zone 108 is affected by the width of the combustion zone 108. Specifically, in FIG. 1A, the combustion zone 108 is narrower than the pyrolysis zone 106, so that the same volume flow rate for shale through the retort 100*a* results in faster vertical flow through the combustion zone 108.

Conversely, in FIG. 1B, in the depicted embodiment, the combustion zone 108 is similar in width to the pyrolysis zone 106, but is shorter than the pyrolysis zone 106, so that shale traveling at the same vertical speed through the pyrolysis zone 106 and the combustion zone 108 spends less time in the combustion zone 108 than in the pyrolysis zone 106. In a further embodiment, the retort 100*b* may similarly be configured such that a dwell time for shale in the combustion zone 108 is shorter than a dwell time for shale in the cool down zone 110. For example, in the depicted embodiment, the cool down zone 110 is taller than the combustion zone 108, so that shale traveling at the same vertical speed through the combustion zone 108 and the cool down zone 110 spends less time in the combustion zone 108 than in the cool down zone 110.

In various embodiments, providing a shorter dwell time for shale in the combustion zone 108 than in the pyrolysis zone 106 and/or the cool down zone 110 may avoid overheating of the retort 100*b* from high-temperature combustion in oxygen. Additionally, in certain embodiments, the retort 100*b* may be configured so that a dwell time for shale in the pyrolysis zone 106 provides effective shale pyrolysis for a target particle size. For example, in one embodiment, a dwell time of one hour for shale in the pyrolysis zone 106 may effectively pyrolyze particles up to four inches in diameter (e.g., heat may penetrate to the center of the particle). Smaller particles may be also be effectively pyrolyzed in the same time. Thus, in certain embodiments, a retort 100*b* may be configured to pyrolyze shale with nonuniform particle sizes. For example, in various embodiments, a retort 100*b* may be configured to pyrolyze shale with nonuniform particle sizes from 0-4 inches in diameter, from 0-6 inches in diameter, from 0-8 inches in diameter, or the like.

The cool down zone 110, in certain embodiments, includes one or more cool down zone heat exchangers 208*c* that cool the combusted shale by transferring heat to a working fluid. Heat from combustion of coke residue may be transferred to the working fluid by cool down heat exchangers 208*c*, which may be substantially similar to the pyrolysis zone heat exchangers 208*a* and the combustion zone heat exchangers 208*b*, and which may similarly be supported by a structural grid 206 and/or by the walls of the retort 100*b*. In the depicted embodiment, heat exchangers 208*c* of the cool down zone 110 form zig-zag descending passages similar to the descending passages of the pyrolysis zone 106, where shale is supported, rolled, and mixed. However, in the depicted embodiment, the cool down zone heat exchangers 208*c* may transfer heat from combustion to the working fluid, rather than transferring heat from the working fluid to the shale. The cool down zone heat exchangers 208*c* may be heated by shale particles and/or exhaust gases exiting the combustion zone 108. In certain embodiments, the working fluid is circulated from the cool down zone heat exchangers 208*c* to heat the pyrolysis zone heat exchangers 208*a*. For example, in one embodiment, steam may be circulated through the cool down zone heat exchangers 208*c* and through the combustion zone heat exchangers 208*b*, superheated by heat from the cool down zone 110 and the combustion zone 108, and circulated to the pyrolysis zone heat exchangers 208*a*, so that heat from combustion and from the water-gas shift reaction is transferred to the pyrolysis zone 106 to pyrolyze shale.

In certain embodiments, the water-gas shift reaction caused by injecting steam into the combustion zone 108 may continue in the cool down zone 110 at lower temperatures, until temperatures fall below a quenching temperature for the water-gas shift reaction. In another embodiment, however, the rate of steam injection may be controlled so that the water-gas shift reaction completes in the combustion zone 108 and does not continue in the cool down zone 110.

In the depicted embodiment, oxygen injection rates may be limited in the combustion zone 108 to avoid overheating, and heat may be transferred to combustion zone heat exchangers 208*b*. However, coke residue may remain in the shale particles due to incomplete combustion. In the depicted embodiment, compressed air is injected into the upper portion of the cool-down zone 110, to combust remaining coke residue. In certain embodiments, compressed air may be injected through apertures of the heat exchangers 208*c*. Combustion in air may result in lower temperatures than combustion in oxygen, but may consume additional coke residue to produce more heat for pyrolysis.

In a certain embodiment, shale may be further cooled in the cool down zone 110 by the cool down zone heat exchangers 208*c*. For example, while the pyrolysis zone heat exchangers 208*a* may be configured to heat shale to pyrolysis temperatures of approximately 750-800° F., the cool down zone heat exchangers 208*c* may be configured to cool shale. For example, in one embodiment, the pyrolysis zone heat exchangers 208*a* of the pyrolysis zone 106 may circulate and inject steam at or above 750-800° F., and the cool down zone heat exchangers 208*c* may circulate and/or inject steam at or near 212° F., or may be cooled by liquid water below 212° F. or by another, lower temperature working fluid. In the depicted embodiment, air is injected in an upper portion of the cool down zone 110 to combust remaining coke residue, and lower-temperature steam is injected in the lower portion of the cool down zone 110, to cool the shale.

In certain embodiments, gases produced by combustion, gases produced by the water-gas shift reaction, and additional gases in the cool down zone 110 such as steam injected for cooling, combustion exhaust from the combustion zone 108, and the like, may exit the retort 100*b* through gas collection apertures 210*b*, which may be disposed at the top of the cool down zone 110, at the bottom of the combustion zone 108, or the like. In certain embodiments, the combustion zone heat exchangers 208*b* and/or the cool down zone heat exchangers 208*c* may include the gas collection apertures 210*b*. The gases exiting the cool down zone 110 (at D) may be received by a distillation chamber 500 as described below with reference to FIG. 5.

In the depicted embodiment, one or more steam cannons 128 heat water to produce steam. The steam cannons 128 may be substantially as described above with regard to FIG. 1A. In the depicted embodiment, a pump (such as the pump 1002 of FIG. 10) may circulate water as the working fluid through one or more heat exchangers 504 in distillation chambers 500 (as described below with reference to FIG. 5), where the water is heated, as gases from the pyrolysis zone 106 and/or the combustion zone 108 are cooled. In one embodiment, the water may then be circulated through the steam cannons 128 to convert the water to steam, and may then be circulated as steam through the pyrolysis zone 106, the combustion zone 108, and/or the cool down zone 110. In another embodiment, the water may be heated by circulation through the heat exchangers 208*b-c* of the combustion zone 108 and/or the cool down zone 110, as the working fluid and the pre-heated water steam may then be provided to the steam cannons 128 to be boosted to a higher temperature for use in the pyrolysis zone 106.

For example, in the depicted embodiment, a first steam cannon 128*a* receives heated water (at A) from a first distillation chamber 500*a*, and boosts the water to steam. The steam from the first steam cannon 128*a* (along with carbon dioxide from combustion in the steam cannon 128*a*) is received, circulated, and injected by the pyrolysis zone heat exchangers 208*a* to pyrolyze shale.

A second steam cannon 128*b*, in the depicted embodiment, receives heated water (at C) from a second distillation chamber 500*b*, and additionally receives heated water that has been circulated through the combustion zone heat exchangers 208*b* and/or the cool down zone heat exchangers 208*c*, where it receives heat from combustion and the water-gas shift reaction. The steam from the second steam cannon 128*b* is then received, circulated, and injected by pyrolysis zone heat exchangers 208*a* to pyrolyze shale. Steam injected in the combustion zone 108 for the water-gas shift reaction may also be from the first and/or second steam cannons 128.

In another embodiment, a shale pyrolysis system may include more or fewer steam cannons 128. For example, in certain embodiments, a shale pyrolysis system may include more than two steam cannons 128, to position steam output closer to particular heat exchangers 208 or injectors 212, or may include a single steam cannon 128 that provides steam to heat exchangers 208 and injectors 212. In another embodiment, a shale pyrolysis system without steam cannons 128 may generate steam at the heat exchangers 208. In certain embodiments, using a pump to circulate liquid water through distillation chamber heat exchangers 504 before using steam cannons 128 to boost the water to steam may provide efficient heat transfer using a liquid working fluid, without using a compressor to compress and move a gaseous working fluid.

In certain embodiments, steam cannons 128 may heat liquid water to produce steam, and/or may receive steam and heat the steam further. For example, in one embodiment, distillation chamber heat exchangers 504 may heat water to steam, and the steam cannons 128 may further heat the steam, and/or may add additional steam by heating liquid water received from a pump, before sending the steam to the pyrolysis zone 106, the combustion zone 108, and/or the cool down zone 110.

Figure 2:
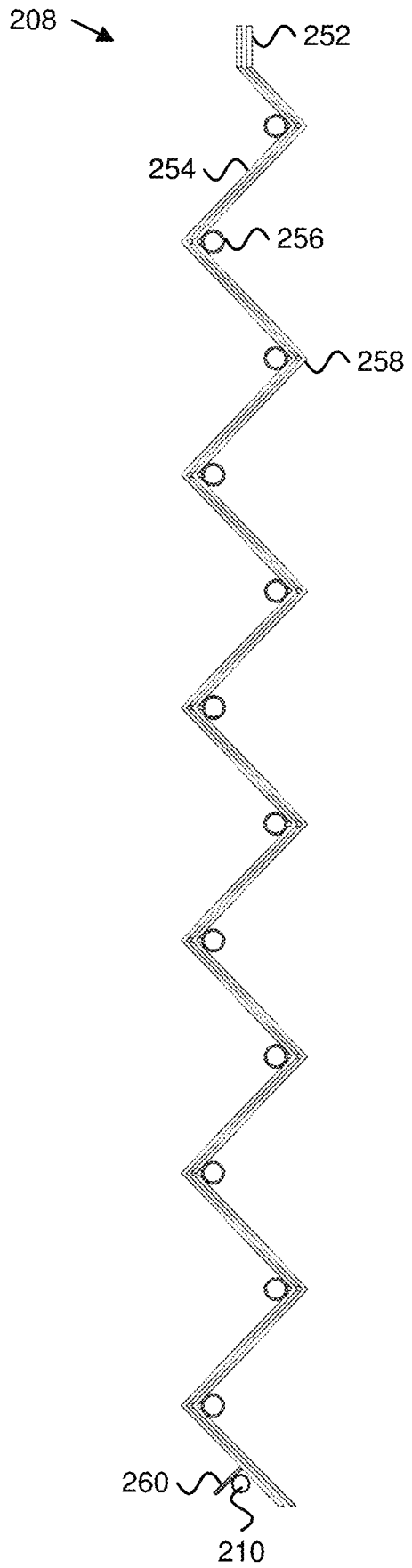
FIG. 2 is a side view illustrating one embodiment of a heat exchanger.

FIG. 2 depicts one embodiment of a heat exchanger 208, in a side view. The heat exchanger 208, in the depicted embodiment, may be a pyrolysis zone heat exchanger 208*a*, a combustion zone heat exchanger 208*b*, and/or a cool down zone heat exchangers 208*c*, as described above. In the depicted embodiment, the heat exchanger 208 includes a mounting point 252, one or more angled surfaces 254, one or more fluid pipes 256, one or more fluid injection apertures 258, one or more gas collection apertures 210, and one or more aperture shields 260.

The mounting point 252, in certain embodiments, may be attached or coupled to a structural grid 206 to support the heat exchanger 208. In the depicted embodiment, the mounting point 252 is located at the top of the heat exchanger 208. In another embodiment, a mounting point 252 may be located at the bottom of the heat exchanger 208, in the middle of the heat exchanger 208, or the like.

On or more angled surfaces 254, in certain embodiments, may provide support and motion for the shale. Shale resting on an angled surface 254 of a heat exchanger 208 may reduce the pressure that would otherwise exist lower in the shale bed or column. Additionally, shale may roll or slide off an angled surface 254, resulting in mixing of the shale as it descends through the retort 100.

In the depicted embodiment, the heat exchanger 208 includes an array of descending angled surfaces 254 at alternating angles configured to form zig-zag descending passages for the shale, as described above with regard to FIG. 1B. Shale may move back and forth gently through a zig-zag passage, and may be heated or cooled by the heat exchanger 208. In certain retorts, shale may be sanded or ground down as it moves within the retort. By contrast, gentle shale motion in a zig-zag passage may reduce or mitigate the wasted energy that might otherwise be spent moving or breaking up shale particles.

In certain embodiments, heat exchangers 208 may be configured to prevent bridging of shale particles across the zig-zag descending passages. Bridging may occur if shale particles jam together in a passage so that the bridged shale particles are no longer descending, thus leaving a void beneath the bridged shale particles that hinders shale flow through the retort 100. In one embodiment, heat exchangers 208 may be configured to prevent bridging of shale particles by configuring an angle of the angled surfaces 254 to be steeper or more vertical than an angle of repose for shale particles. Heating of the angled surfaces 254 may also avoid bridging, in certain embodiments Additionally, repetition of angled surfaces 254 in a descending sequence or array may prevent bridging due to upper angled surfaces 254 bearing weight that would otherwise rest on the lower angled surfaces 254.

In the depicted embodiment, the heat exchangers 208 include fluid pipes 256. Fluid pipes 256 may carry a working fluid, such as steam, or may carry another fluid, such as air to be injected into the shale bed or column for air combustion in the into the cool down zone 110.

In the depicted embodiment, the heat exchangers 208 include one or more fluid injection apertures 258, for injecting the working fluid directly into the shale (e.g., into the shale bed, into spaces between shale particles, or the like). In one embodiment, the fluid injection apertures 258 may receive working fluid (or another fluid) from the fluid pipes 256.

In certain embodiments, heat exchangers 208 may include one or more gas collection apertures 210 for removing gases from the retort 100*b*. As described above, gas collection apertures 210 may remove gases from the pyrolysis zone 106, the combustion zone 108, the cool down zone 110, or the like. In the depicted embodiment, gas collection apertures 210 are disposed at the bottom of the heat exchanger 208. In another embodiment, gas collection apertures 210 may be disposed at the top of a heat exchanger 208 (e.g., for a cool down zone heat exchanger 208*c*). In the depicted embodiment, gas collection apertures 210 communicate with pipes similar to the fluid pipes 256, for removing gases from the retort 100*b*.

In certain embodiments, gas collection apertures 210 may be shielded on top to exclude descending fines from the gas collection apertures 210. In the depicted embodiment, an aperture shield 260 shields a gas collection aperture 210 by covering the upper surface of the gas collection aperture 210. Providing an aperture shield 260 may allow gases to enter the gas collection aperture 210, but may provide an angled surface that diverts descending fines away from the gas collection aperture 210. Thus, although some airborne fines may still pass through the gas collection aperture 210 with the removed gases, a portion of the fines may be excluded from the gas collection aperture 210 by the aperture shield 260.

Figure 3:
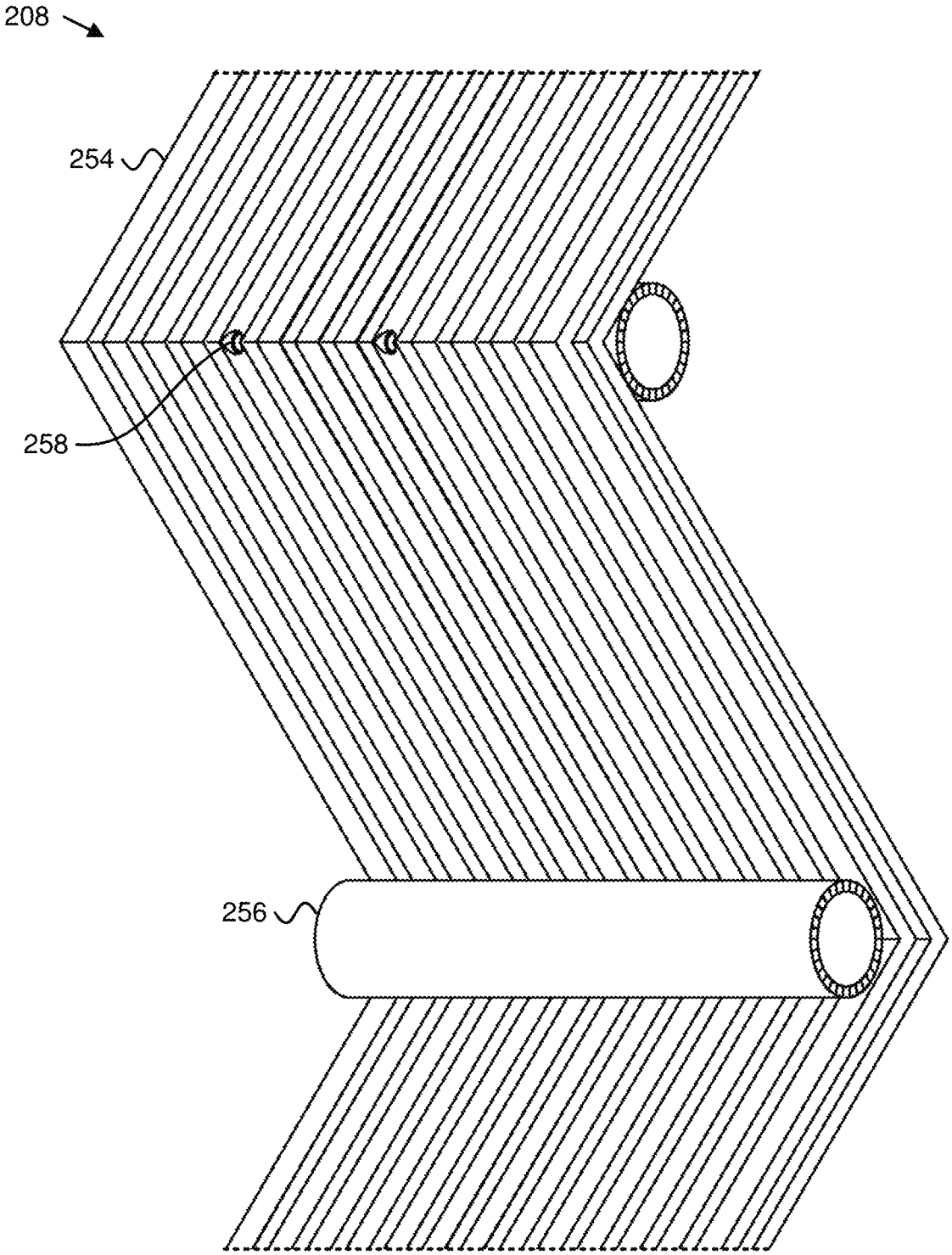
FIG. 3 is a perspective view illustrating a further embodiment of a heat exchanger.

FIG. 3 illustrates a further embodiment of a portion of a heat exchanger 208, which may be substantially as described above, including one or more angled surfaces 254, fluid pipes 256, and fluid injection apertures 258, as described above. In the depicted embodiment, the angled surfaces 254 are ridged. In another embodiment, angled surfaces 254 of a heat exchanger 208 may be smooth. In certain embodiments, providing a ridged surface for a heat exchanger 208 may facilitate heat exchange by increasing the surface area of the heat exchanger 208. In one embodiment, fluid pipes 256 may be disposed in an interior angle where angled surfaces 254 of the heat exchanger 208 meet, and fluid injection apertures 258 may extend through the heat exchanger 208.

Figure 4:
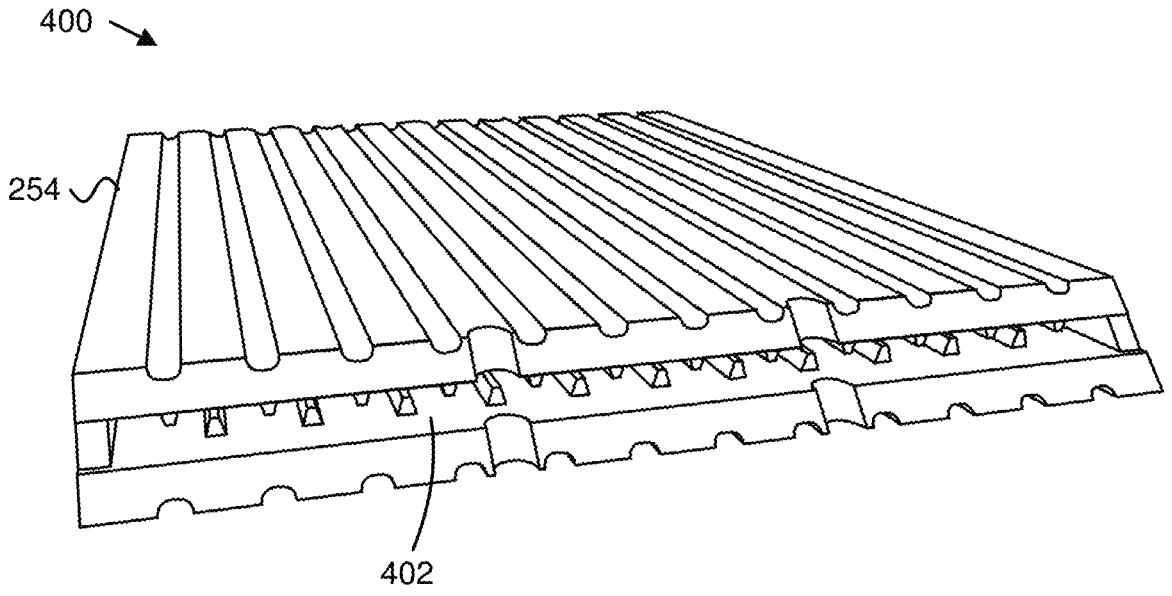
FIG. 4 is a perspective view illustrating a portion of a heat exchanger.

FIG. 4 illustrates a portion 400 of a heat exchanger, such as the heat exchanger 208 described above, including an angled surface 254. Multiple such portions 400 may be joined to form an array of descending angled surfaces 254 for a heat exchanger 208. In various embodiments, a heat exchanger 208 may include one or more channels for circulating the working fluid, such that heat is transferred between the working fluid and the descending angled surfaces 254. For example, in the depicted embodiment a channel 402 extends through the portion 400 of the heat exchanger 208. In a certain embodiment, the channel 402 is ridged, similar to the angled surface 254, to facilitate heat transfer between the working fluid in the channel 402 and shale contacting the angled surface 254.

In one embodiment, working fluid circulated through a channel 402 may be injected into the shale through fluid injection apertures 258. In another embodiment, working fluid circulated through a channel 402 may be kept separate from the shale, and working fluid in fluid pipes 256 may be injected into the shale through fluid injection apertures 258. For example, in one embodiment, working fluid may be heated without contamination by other gases, by circulation through channels 402 in the combustion zone 108 and the cool down zone 110, and may then be circulated through fluid pipes 256 in the pyrolysis zone 106, and injected into the shale. In another embodiment, a heat exchanger 208 may circulate working fluid in fluid pipes 256 and not in an interior channel 402.

Figure 5:
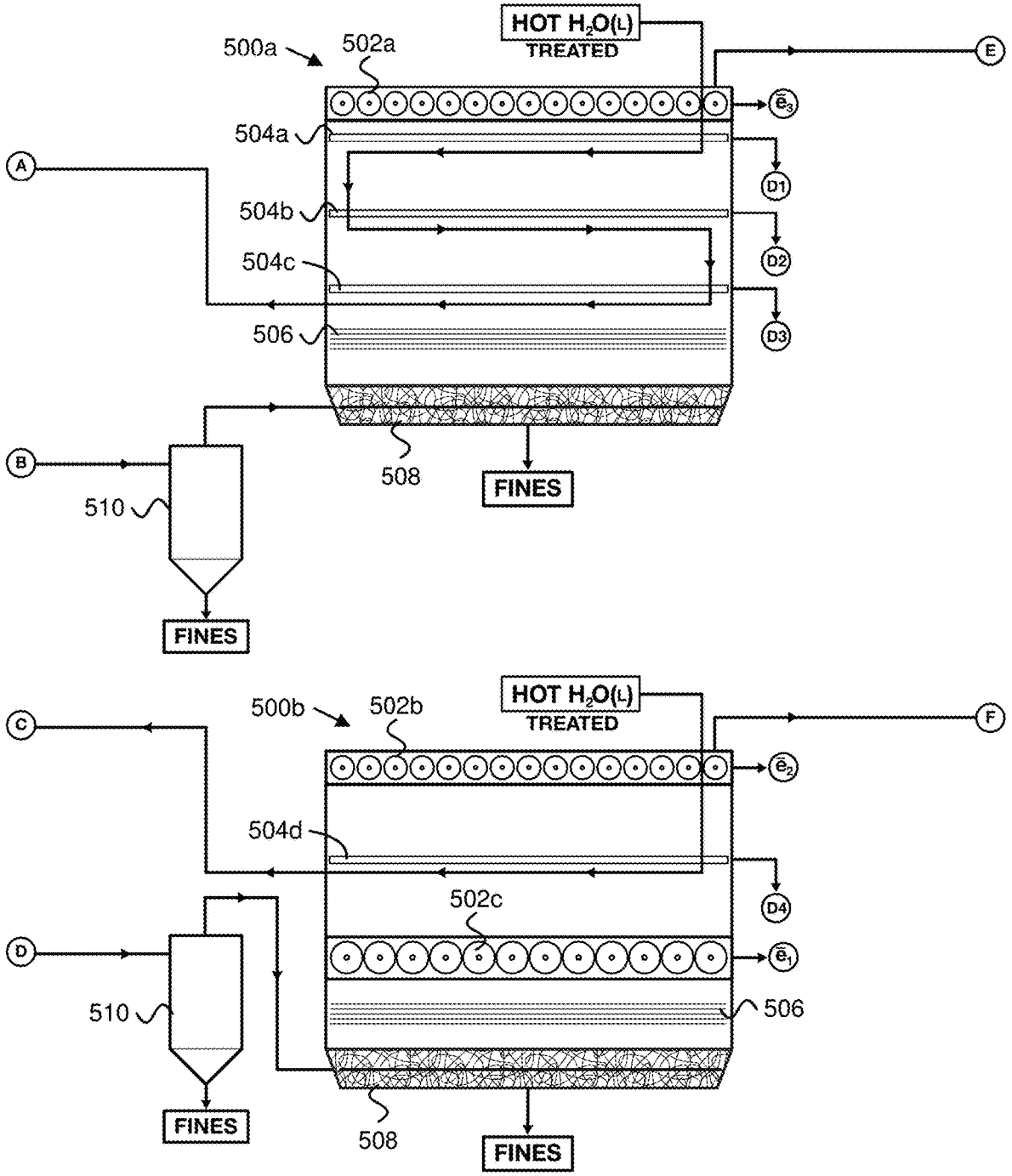
FIG. 5 is a cross section view illustrating one embodiment of a portion of a shale pyrolysis system, comprising distillation chambers.

FIG. 5 depicts one embodiment of a portion of a shale pyrolysis system, comprising distillation chambers 500, depicted in cross section. In the depicted embodiment, a first distillation chamber 500*a* receives gases exiting the pyrolysis zone 106 (at B), and a second distillation chamber 500*b* receives gases exiting the cool down zone 110 (at C). In general, in various embodiments, distillation chambers 500 may be room-sized or other-sized chambers that receive gases from the retort 100, and that separate one or more condensable fractions or distillate cuts from the received gases.

In the depicted embodiment, cyclone separators 510 separate fines from the gases. In certain embodiments, cyclone separators 510 may remove fines that remain in the gases after the gases pass through the cyclone separators 116 of FIG. 1A. In another embodiment, however a shale pyrolysis system may include a single level of cyclonic separation, rather than two levels). For example, in one embodiment, cyclone separators 510 may receive gases from gas collection apertures 210 of FIG. 1B, without an additional level of cyclonic separation.

The distillation chambers 500, in various embodiments, may include one or more filters 506, 508, one or more heat exchangers 504, and one or more electrical generators 502. The filters 506, 508, in certain embodiments, filter small particles or fines from gases entering the distillation chambers 500. Filters 506, 508, in various embodiments, may include any component or device that removes fines or other particulate matter from gases. In the depicted embodiment, a distillation chamber 500 includes a first filter 508, which may be a physical filter comprising a steel mesh, steel packing, or another mesh, packing, or fibrous material that physically blocks larger fines from entering the distillation chambers 500.

In a further embodiment, a distillation chamber 500 may include a second filter 506, to remove fines that were not removed by the first filter 508. In certain embodiments the second filter 506 may be an electrostatic precipitator. Various further or other filtration devices suitable for use with distillation chambers 500 will be clear in view of this disclosure. Fines and/or other residue may be periodically removed from the cyclone separators 510 and the filters 506, 508, and returned to the retort 100. In certain embodiments, a distillation chamber 500 may include a filter wash system including nozzles or other apertures configured to remove fines from the filters 506, 508 by spraying water or another liquid over the filters. A filter wash system may operate continuously, or may be engaged periodically or at intervals to clean the filters 506, 506. Fines washed off the filters may be collected in a compartment, trough, tray, or the like and may be manually removed, transferred out of the compartment by augurs, or the like.

In certain embodiments, a distillation chamber 500 may include one or more heat exchangers 504 that remove one or more distillate products from the gases entering the distillation chamber 500. A distillate product may refer to any component or range of components of the gases entering a distillation chamber 500 that are condensed by a heat exchanger 504 and removed from the distillation chamber 500 in liquid form. In various embodiments, a heat exchanger 504 may include one or more tubes, pipes, channels, or the like, in thermal contact with the gases in the distillation chamber 500, and water or another working fluid may be circulated through the heat exchangers 504. The working fluid may be cooler than the gases near a heat exchanger 504, so that distillate products condense out of the gases on or near the heat exchanger 504, cooling the gases, and heating the working fluid. In various embodiment, a trough, plate, or tray may be provided underneath a heat exchanger 504 to receive the distillate products removed by the heat exchanger 504. In certain embodiments, the heat exchangers 504 of the distillation chambers 500 may be configured to transfer heat from gases, rather than into or out of shale, and may therefore be different from the heat exchangers 208 described above with reference to FIGS. 2-4.

In certain embodiments, as depicted in FIG. 5, a width of a distillation chamber 500 may be greater than a height of a distillation chamber 500. In another embodiment, a width of a distillation chamber 500 may be greater than half the height of a distillation chamber 500, greater than two/thirds the height of the distillation chamber 500, or the like. By comparison to narrow distillation columns, providing a wide distillation chamber 500 may accommodate a large volume of gasses from the retort 100 (or from another vessel producing gases that contain condensable hydrocarbons), and may provide a large area for the heat exchangers 504, to facilitate condensation of distillate products.

In the depicted embodiment, the first distillation chamber 500*a*, which receives gases from the pyrolysis zone 106 of the retort 100, include heat exchangers 504*a-c* at three vertical levels or positions. Water may be circulated first through the upper heat exchanger 504*a*, then through the middle heat exchanger 504*b*, then through the lower heat exchanger 504*c*, while gases may enter the distillation chamber below the lower heat exchanger 504*c*. Accordingly, the temperature of the gases and of the working fluid may be highest at the lower heat exchanger 504*c*, and lowest at the upper heat exchanger 504*a*. The heat exchangers 504 may remove different distillate products from the gases according to their temperatures.

For example, gases may enter the first distillation chamber 500*a* at approximately 700-800° F., while the lower heat exchanger 504*c* may be at approximately 450° F., and may remove a heavy oil cut D3 of distillate products. In a further embodiment, the middle heat exchanger 504*b* may remove a medium weight cut D2 of distillate products at approximately 300° F. Similarly, the upper heat exchanger 504*a* may remove a light oil cut D1 of distillate products at approximately 180° F.

In the depicted embodiment, a second distillation chamber 500*b*, which receives gases from the cool down zone 110 of the retort 100, includes a single heat exchanger 504*d* that removes a fourth cut D4 of distillate products from the gases. The number and temperature of heat exchangers 504 for distillate chambers 500 may, in certain embodiments, be different from the number and temperature of heat exchangers 504 in the depicted embodiment, depending on desired temperature cut points for different distillate products.

In certain embodiments, a distillation chamber 500 may include one or more electrical generators 502 powered by heat. Electrical generators 502 may be organic Rankine cycle generators, or other heat-powered electrical generators. In the depicted embodiment, the first and second distillation chambers 500 include electrical generators 502*a*, 502*b* above the heat exchangers 504, so that the generators 502*a*, 502*b* are powered by heat remaining in the gases after distillate products are removed by the heat exchangers 504. Additionally, in the depicted embodiment, the second distillation chamber 500*b* includes generators 502*c* below the heat exchanger(s) 504, so that the generators 502*c* are powered by heat from higher-temperature gases, prior to distillate removal. In either distillation chamber 500, gaseous products that are not condensed by the heat exchangers 504, such as methane through heptane, carbon dioxide, hydrogen sulfide, hydrogen from the water-gas shift reaction, and the like, may exit the distillation chamber 500 as gases.

As described above, steam cannons 128 may receive heated water from the heat exchangers 504 of the distillation chambers, and boost the water to steam for pyrolysis of shale in the retort 100. In one embodiment, heat exchangers 504 and lines between the heat exchangers 504 and the steam cannons 128 may be pressurized, so that water is circulated as liquid at temperatures above the boiling point, and allowed to flash to steam at the steam cannons 128. In another embodiment, the water may exit the heat exchangers 504 as steam, and may be further heated to pyrolysis temperatures by the steam cannons 128. In general, in various embodiments, circulating water through the heat exchangers 504, then through the steam cannons 128 may return heat to the retort 100 that exited with gases leaving the pyrolysis zone 106 or the cool down zone 110. Thus, heat generated by combustion of coke residue and by the water-gas shift reaction in the retort 100 may be used in the retort 100 for pyrolysis, may exit the retort 100 with gases, and may be returned (in part) to the retort 100 via heat exchangers 504, with a temperature boost from steam cannons 128 to compensate for heat lost to the environment.

Figure 6:
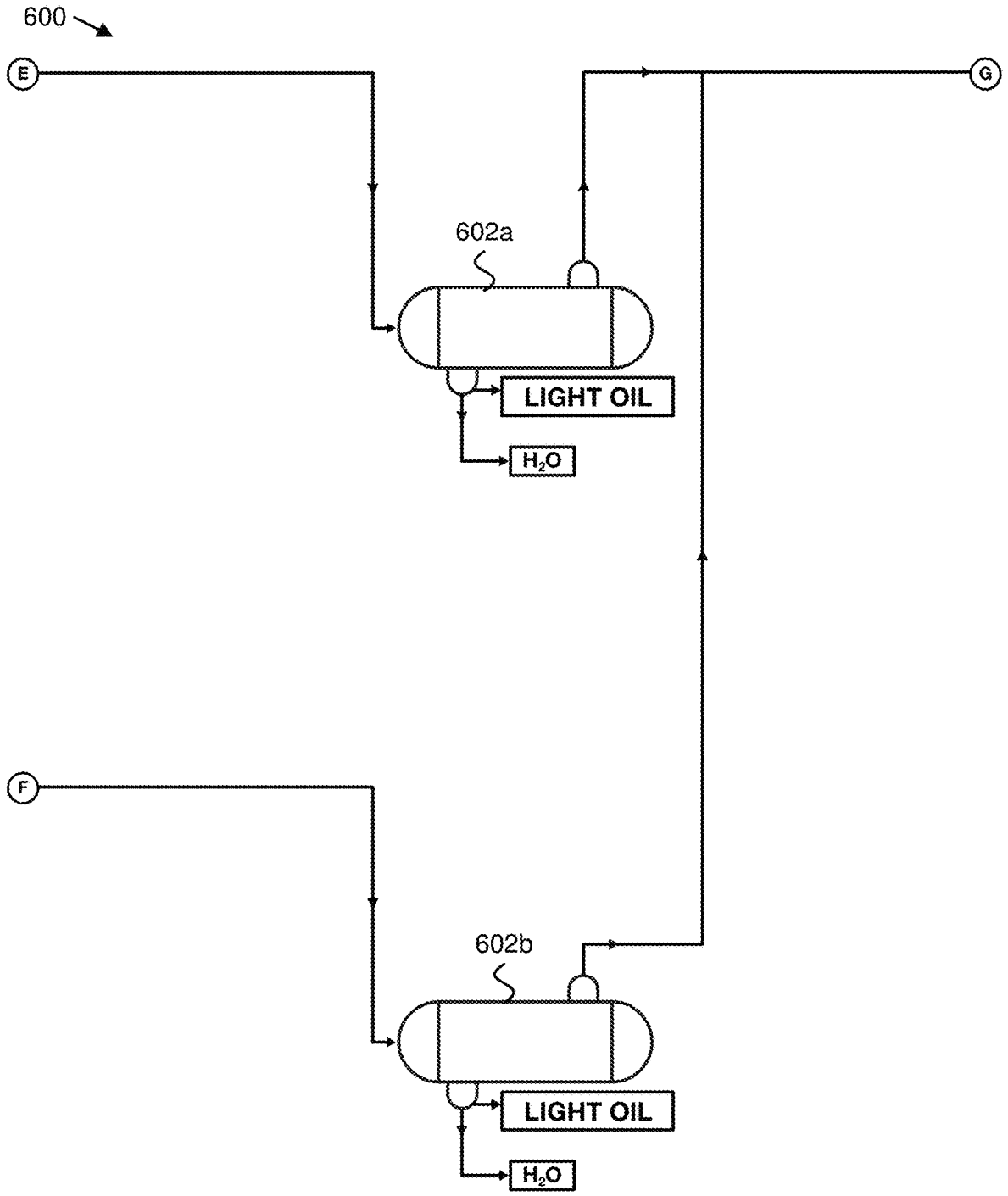
FIG. 6 is a side view illustrating one embodiment of a portion of a shale pyrolysis system, comprising liquid/gas separation equipment.

FIG. 6 depicts one embodiment of a portion of a shale pyrolysis system, comprising distillation liquid/gas separation equipment 600. In the depicted embodiment, the liquid/gas separation equipment 600 includes horizontal separators 602. In various embodiments, horizontal separators 602 may be liquid/gas separators, water/oil/gas separators, or the like. A first horizontal separator 602*a*, in the depicted embodiment, receives gases that exited the pyrolysis zone 106 and that were not condensed in the first distillation chamber 500*a*. Similarly, a second horizontal separator 602*b*, in the depicted embodiment, receives gases that exited the cool down zone 110 and that were not condensed in the second distillation chamber 500*b*. The separators 602 may separate vapor and/or suspended droplets from the entering gases. Water and light oil may be removed as liquids. Remaining gases may be processed by the gas plant 700 of FIG. 7.

Figure 7:
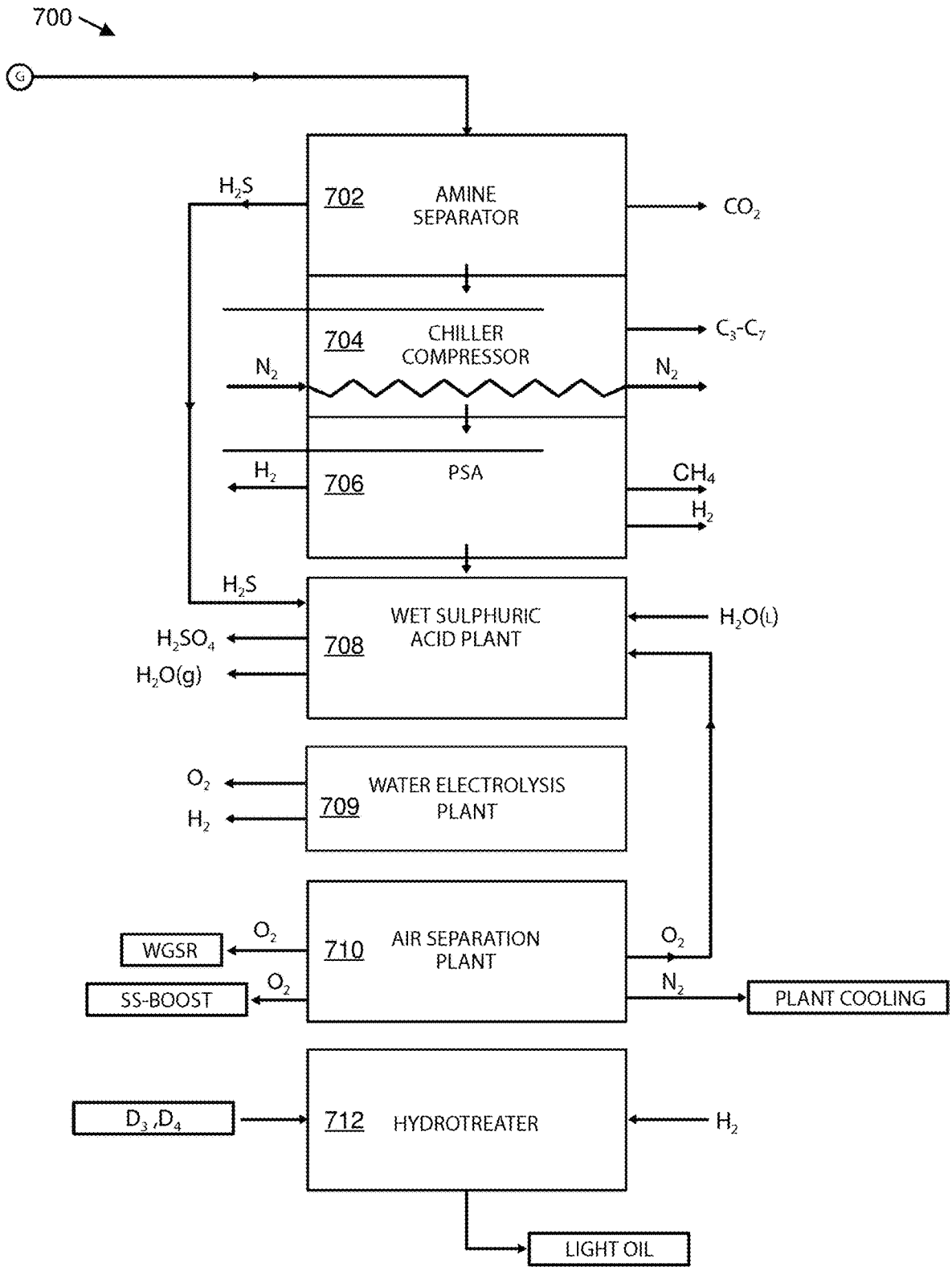
FIG. 7 is a schematic block diagram illustrating one embodiment of a portion of a shale pyrolysis system, comprising a gas plant.

FIG. 7 depicts one embodiment of a portion of a shale pyrolysis system, comprising a gas plant 700. In the depicted embodiment, the gas plant 700 receives gases from the liquid/gas separation equipment 600 of FIG. 6. In the depicted embodiment, an amine separator 702 removes hydrogen sulfide and carbon dioxide from the entering gases. A chiller/compressor 704 uses chilled nitrogen or air (e.g., compressed, cooled, and evaporated air) to chill the gases, removing propane through heptane. A pressure swing adsorption (PSA) component 706 removes hydrogen and methane from the gases.

In the depicted embodiment, a wet sulfuric acid plant 708 uses hydrogen sulfide from gases produced in the retort 100 to produce sulfuric acid and heat. In a wet sulfuric acid process, hydrogen sulfide may be combusted, further oxidized, hydrated, and condensed, producing liquid sulfuric acid. Combustion, oxidation, hydration, and condensation may also produce heat in significant quantities. In certain embodiments, the wet sulfuric acid plant 708 may use the heat from sulfuric acid production to convert water to steam, and may return the steam to the heated paddles 114 of the pyrolysis zone 106, or the pyrolysis zone heat exchangers 208*a*. In one embodiment, high-temperature steam from the wet sulfuric acid plant 708 may be circulated directly to the pyrolysis zone 106. In another embodiment, steam from the wet sulfuric acid plant 708 may be circulated through steam cannons 128, heat exchangers 122, 208*b-c*, or the like, to boost the temperature of the steam before the steam is used for pyrolysis. In certain embodiments, steam from the wet sulfuric acid plant 708 may be circulated to the retort 100, or to another vessel where the steam is used to produce gases with condensable hydrocarbons.

In certain embodiments, a water electrolysis plant 709 may use electricity to electrolyze water, producing hydrogen and oxygen. In further embodiments, electricity for the water electrolysis plant 709 may be provided by the electrical bus and distributor 902 described below with reference to FIG. 9. In some embodiments, hydrogen and/or oxygen produced by the water electrolysis plant 709 may be stored in the tank farm 800 described below with regard to FIG. 8. In further embodiments, hydrogen and/or oxygen produced by the water electrolysis plant 709 may be used elsewhere in the shale pyrolysis system. For example, steam cannons 128 may use oxy-fuel combustion to heat water, producing steam, and may use oxygen and/or hydrogen from the water electrolysis plant 709. In a further embodiment, oxygen from the water electrolysis plant 709 may be injected into the combustion zone 108.

In certain embodiments, an air separation plant 710 may separate air to produce oxygen and nitrogen. Oxygen produced by the air separation plant 710 may be used by the steam cannons 128, the injectors 120, 212, and/or the wet sulfuric acid plant 708. Nitrogen may be used for cooling (e.g., by the chiller/compressor 704). In the depicted embodiment, a hydrotreater 712 uses hydrogen (which may be produced by the water-gas shift reaction and separated from other gases by the PSA component 706, or produced by the water electrolysis plant 709) to produce light oil from the heavier cuts D3, D4 of distillate products produced by the distillation chambers 500. In certain embodiments, the first distillation chamber 500*a* may remove phenols and heterocyclic compounds (e.g., compounds resembling cyclic hydrocarbons, but with another atom, such as a sulfur atom, in place of a carbon atom) in the heavier cut D3, and the hydrotreater 712 may treat the heavier cut D3 from the first distillation chamber 500*a* without treating the other cuts D1, D2, D4 of distillate products.

Figure 8:
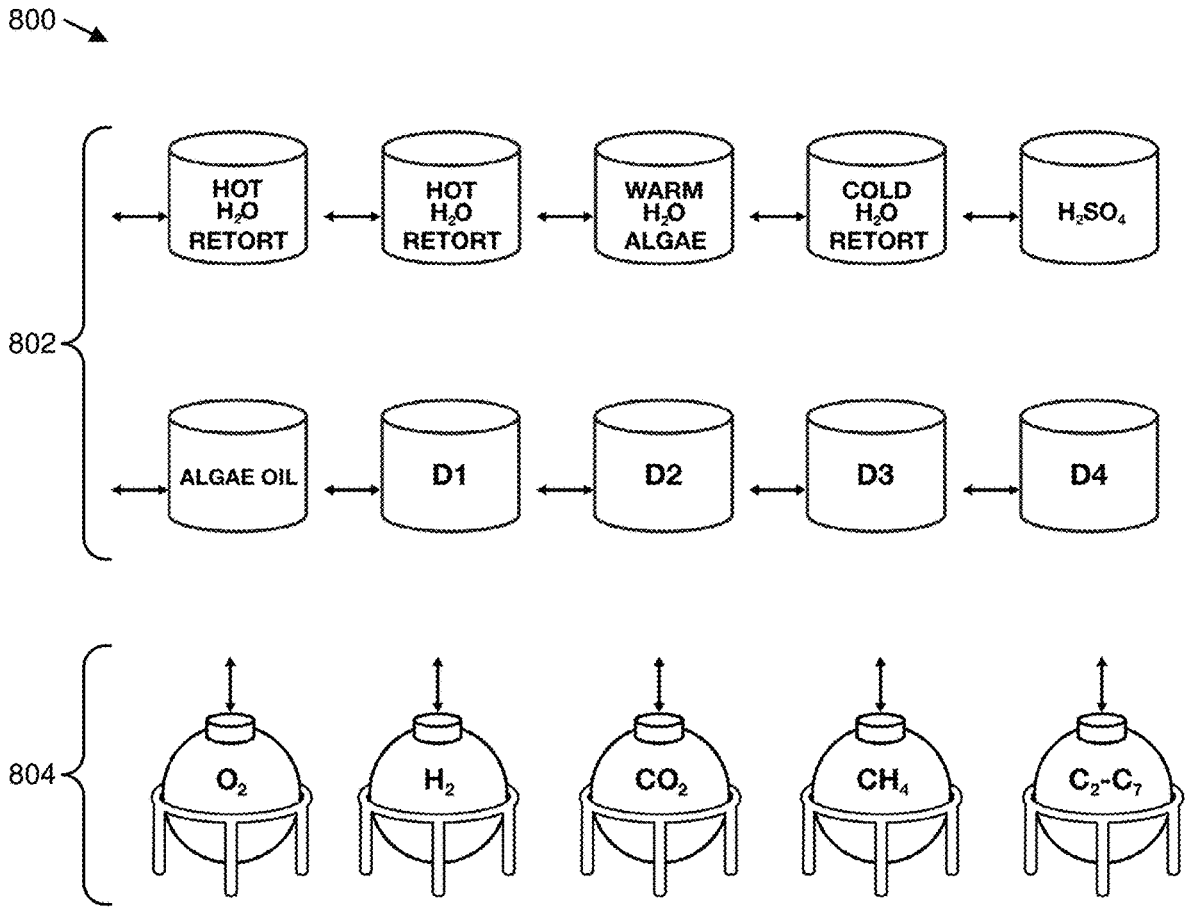
FIG. 8 is a schematic block diagram illustrating one embodiment of a portion of a shale pyrolysis system, comprising a tank farm.

FIG. 8 depicts one embodiment of a portion of a shale pyrolysis system, comprising a tank farm 800. A tank farm 800, in various embodiments, includes liquid holding tanks 802 and gas holding tanks 804. For example, in the depicted embodiment, the tank farm 800 includes liquid holding tanks 802 for water at different temperatures, sulfuric acid, distillate products, and the like, and gas holding tanks 804 for oxygen, hydrogen, carbon dioxide, methane, ethane through heptane, and the like. In another embodiment, a shale pyrolysis system may include a tank farm 800 with more or fewer holding tanks 802, 804, as needed.

Figure 9:
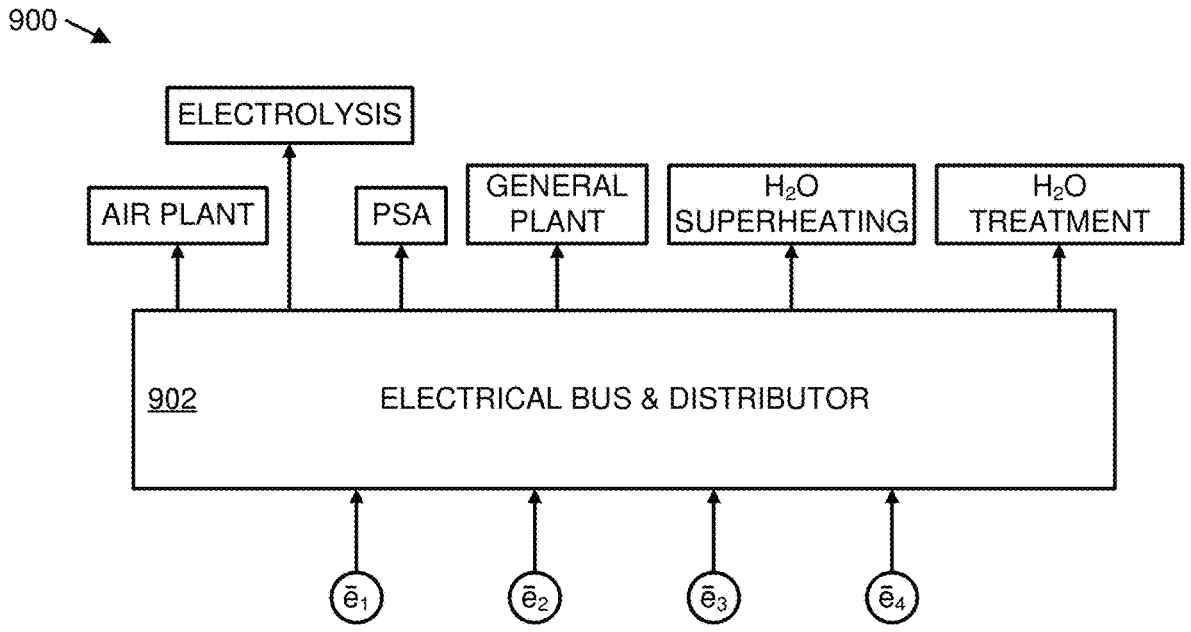
FIG. 9 is a schematic block diagram illustrating one embodiment of a portion of a shale pyrolysis system, comprising an electrical distribution plant.

FIG. 9 depicts one embodiment of a portion of a shale pyrolysis system, comprising an electrical distribution plant 900. In the depicted embodiment, the electrical distribution plant 900 includes an electrical bus and distributor 902 that receives electricity from generators 502 in the distillation chambers 500, and/or generators 126 in the rotational cooler 124. The electrical bus and distributor 902 may distribute electricity to the air separation plant 710, the water electrolysis plant 709, the PSA component 606, the water treatment plant 1000, or elsewhere for general plant use. In certain embodiments, electricity from the electrical bus and distributor 902 may be used to produce superheated steam (e.g., for injection into the retort), or to otherwise heat water used by the shale pyrolysis system.

Figure 10:
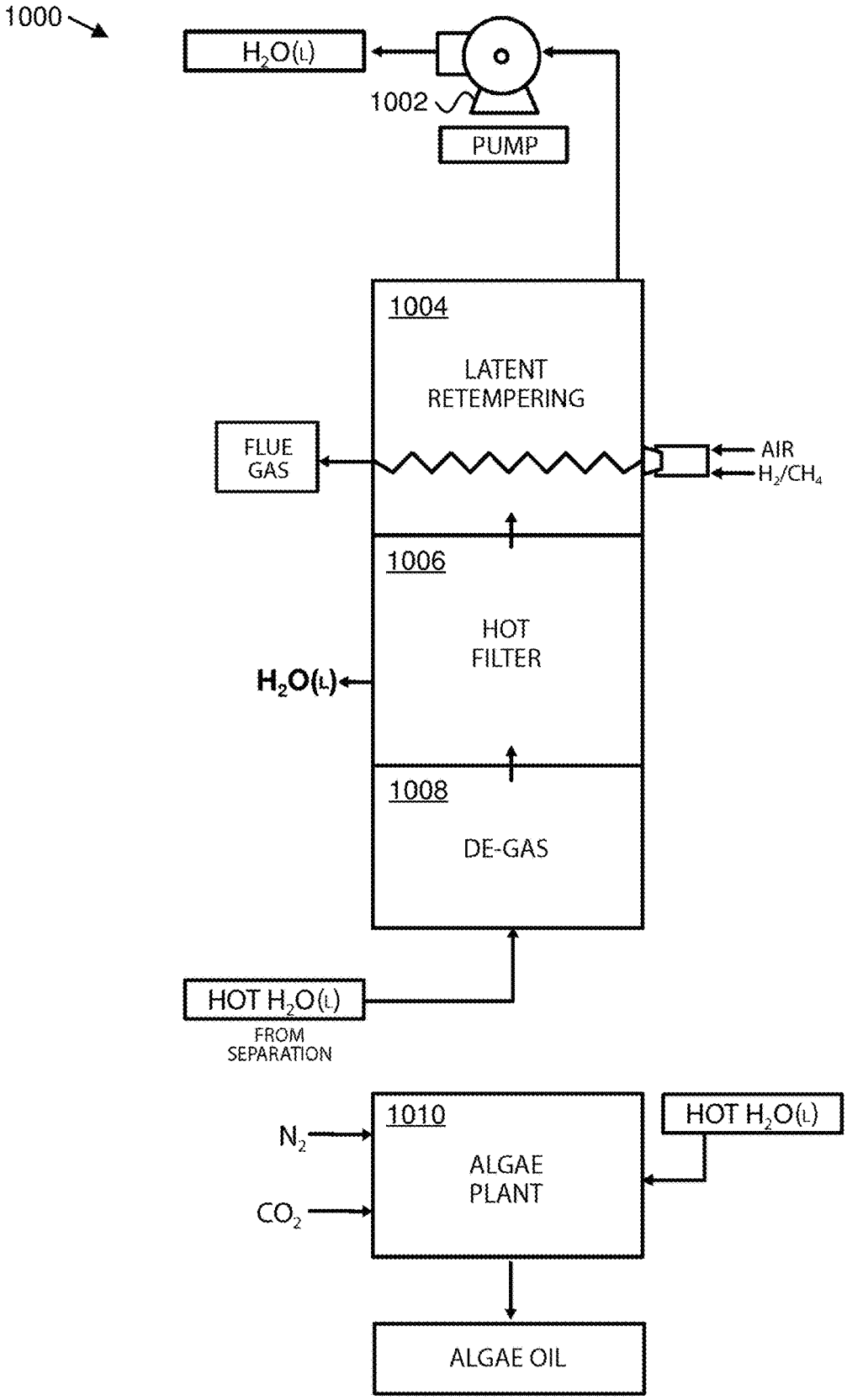
FIG. 10 is a schematic block diagram illustrating one embodiment of a portion of a shale pyrolysis system, comprising a water treatment plant.

FIG. 10 depicts one embodiment of a portion of a shale pyrolysis system, comprising a water treatment plant 1000. Water from the liquid/gas separation equipment 600 may be degassed by a degassing component 1008, and filtered by a filter 1006. Warm water may be circulated to an algae plant 1010, in which algae processes carbon dioxide (e.g., from the amine separator 702) to produce algae oil. A latent retempering unit 1004 may burn hydrogen, methane, or other fuel to heat water, retempering it to the temperature at which it enters the distillation chambers 500. The pump 1002 may circulate the heated water to the distillation chambers 500, to steam cannons 128 and/or to the retort 100 (or another vessel where the steam is used to produce gases with condensable hydrocarbons).

Figure 11:
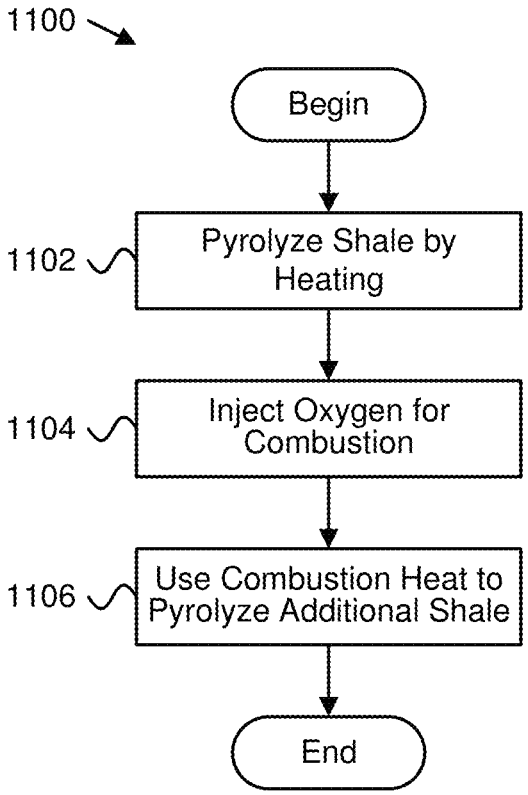
FIG. 11 is a schematic flow chart diagram illustrating one embodiment of a method for shale pyrolysis.

FIG. 11 depicts one embodiment of a method 1100 for shale pyrolysis. The method 1100 begins, and shale is pyrolyzed 1102 by heating the shale in a retort 100. Oxygen is injected 1104 into the retort 100, to combust coke residue in the pyrolyzed shale. Heat from the combustion is used 1106 to pyrolyze additional shale in the same retort 100, and/or in an additional retort 100, and the method 1100 ends. For example, in one embodiment, heat exchangers 122 may transfer combustion heat to a working fluid, and circulate the working fluid to a pyrolysis zone 106 in the same retort 100. In another embodiment, shale may be pyrolyzed in a retort 100, then combusted in the same retort 100, and heat exchangers 122 may transfer combustion heat to a working fluid, and circulate the working fluid to pyrolyze shale in another retort 100.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system comprising:

a retort for shale pyrolysis, the retort comprising a pyrolysis zone, the pyrolysis zone comprising one or more pyrolysis zone heat exchangers that transfer heat from a working fluid to shale for heating and pyrolyzing the shale, the pyrolysis zone further comprising descending angled surfaces at alternating angles, the descending angled surfaces disposed to form one or more constant-width zig-zag descending passages for the shale;

a combustion zone comprising one or more injectors that inject oxygen to combust coke residue in the pyrolyzed shale; and a cool down zone comprising one or more cool down zone heat exchangers that cool post-combustion shale by transferring heat to the working fluid, wherein the working fluid is circulated to heat the pyrolysis zone heat exchangers.

2. The system of claim 1, wherein the pyrolysis zone is disposed above the combustion zone and the combustion zone is disposed above the cool down zone.

3. The system of claim 2, further comprising a shale loading interlock disposed above the pyrolysis zone, and a shale removal interlock disposed below the cool down zone to produce a vertical flow of shale through the pyrolysis zone, the combustion zone, and the cool down zone.

4. The system of claim 2, wherein a dwell time for shale in the combustion zone is shorter than a dwell time for shale in the pyrolysis zone and a dwell time for shale in the cool down zone.

5. The system of claim 1, wherein the pyrolysis zone heat exchangers comprise the descending angled surfaces.

6. The system of claim 1, wherein the injectors inject steam with the oxygen to produce additional heat in a water-gas shift reaction.

7. The system of claim 1, further comprising a plurality of distillation chambers, the plurality of distillation chambers comprising a first distillation chamber that receives gases exiting the pyrolysis zone, and a second distillation chamber that receives gases exiting the cool down zone, wherein at least one distillation chamber of the plurality of distillation chambers comprises:

one or more filters that filter fines from gases entering the at least one distillation chamber;

one or more heat exchangers that remove one or more distillate products from the gases; and one or more electrical generators powered by heat remaining in the gases.

8. The system of claim 7, further comprising a pump, and one or more steam cannons that heat water to produce steam, wherein the pump circulates water as the working fluid through the one or more heat exchangers of the distillation chambers, through the steam cannons to convert the water to steam, and through one or more of the pyrolysis zone, the combustion zone, and the cool down zone.

9. The system of claim 1, further comprising a wet sulfuric acid plant that uses hydrogen sulfide from gases produced in the retort to produce sulfuric acid and heat, uses the heat to convert water to steam, and returns the steam to the pyrolysis zone heat exchangers.

10. The system of claim 1, wherein the one or more pyrolysis zone heat exchangers comprise the descending angled surfaces, wherein the one or more pyrolysis zone heat exchangers are configured to prevent bridging of shale particles across the zig-zag descending passages.

11. The system of claim 10, wherein the one or more pyrolysis zone heat exchangers further comprise one or more channels for circulating the working fluid, such that heat is transferred between the working fluid and the descending angled surfaces.

12. The system of claim 10, wherein the one or more pyrolysis zone heat exchangers further comprise one or more apertures for injecting the working fluid directly into the shale, and one or more gas collection apertures for removing gases from the pyrolysis zone, wherein the one or more gas collection apertures are shielded on top to exclude descending fines from the one or more gas collection apertures.

13. The system of claim 1 wherein the retort is configured to pyrolyze shale with nonuniform particle sizes from 0-4 inches in diameter.

14. The system of claim 1, wherein compressed air is injected into an upper portion of the cool-down zone, to combust remaining coke residue.

15. A system comprising:

a retort for shale pyrolysis, the retort comprising:

a pyrolysis zone, the pyrolysis zone comprising one or more pyrolysis zone heat exchangers that transfer heat from a working fluid to shale for heating and pyrolyzing the shale, the pyrolysis zone further comprising descending angled surfaces at alternating angles, the descending angled surfaces disposed to form one or more constant-width zig-zag descending passages for the shale;

a combustion zone comprising one or more injectors that inject oxygen to combust coke residue in the pyrolyzed shale; and a cool down zone comprising one or more cool down zone heat exchangers that cool post-combustion shale by transferring heat to the working fluid, wherein the working fluid is circulated to heat the pyrolysis zone heat exchangers; and one or more distillation chambers that receive gases containing condensable hydrocarbons, wherein the retort produces the gases and wherein a distillation chamber comprises:

one or more filters that filter fines from gases entering the distillation chamber;

one or more heat exchangers that remove one or more distillate products from the gases; and one or more electrical generators powered by heat remaining in the gases.

16. The system of claim 15, further comprising a pump, and one or more steam cannons that heat water to produce steam, wherein the pump circulates water through the one or more heat exchangers of the distillation chambers to preheat the water, through the steam cannons to convert the water to steam, and to a vessel where the steam is used in production of the gases.

17. The system of claim 15, further comprising a wet sulfuric acid plant that uses hydrogen sulfide from the gases to produce sulfuric acid and heat, uses the heat to convert water to steam, and returns the steam to a vessel where the steam is used in production of the gases.

* * * * *